US010456640B2

(12) United States Patent
Rouzier et al.

(10) Patent No.: US 10,456,640 B2
(45) Date of Patent: Oct. 29, 2019

(54) HOCKEY STICK WITH VARIABLE STIFFNESS SHAFT

(71) Applicant: BAUER HOCKEY LTD., Blainville (CA)

(72) Inventors: Edouard Rouzier, Montreal (CA); Martin Chambert, Piedmont (CA)

(73) Assignee: Bauer Hockey, LLC, Exeter, NH (US)

( * ) Notice: Subject to any disclaimer, the term of this patent is extended or adjusted under 35 U.S.C. 154(b) by 0 days.

(21) Appl. No.: 15/842,033

(22) Filed: Dec. 14, 2017

(65) Prior Publication Data

US 2019/0184249 A1 Jun. 20, 2019

(51) Int. Cl.

| | |
|---|---|
| ***A63B 59/70*** | (2015.01) |
| ***A63B 60/08*** | (2015.01) |
| ***A63B 60/52*** | (2015.01) |
| *A63B 102/24* | (2015.01) |
| *A63B 102/22* | (2015.01) |

(52) U.S. Cl.

CPC ..... *A63B 59/70* (2015.10); *A63B 60/08* (2015.10); *A63B 60/52* (2015.10); *A63B 2102/22* (2015.10); *A63B 2102/24* (2015.10); *A63B 2209/02* (2013.01)

(58) Field of Classification Search

CPC ..... A63B 59/70; A63B 2102/24

USPC ..... 473/560–563

See application file for complete search history.

(56) References Cited

U.S. PATENT DOCUMENTS

| | | | | |
|---|---|---|---|---|
| D206,234 | S | 11/1966 | Sasse | |
| D237,514 | S | 11/1975 | Miller | |
| D237,636 | S | 11/1975 | Leclerc | |
| D244,219 | S | 5/1977 | Poirier | |
| D244,220 | S | 5/1977 | De brey | |
| 4,116,440 | A | 9/1978 | Takeshima | |
| 4,470,599 | A | 9/1984 | Usher, Jr. | |
| 4,629,191 | A | 12/1986 | Mancuso | |
| 4,964,192 | A | 10/1990 | Marui | |
| 5,217,380 | A | 6/1993 | Martinet | |
| D344,559 | S | 2/1994 | Ilacqua et al. | |
| 5,306,003 | A | 4/1994 | Pagotto | |
| D360,443 | S | 7/1995 | Berghash | |
| D363,326 | S | 10/1995 | LeClerc | |
| 5,460,372 | A | 10/1995 | Cook | |
| 5,511,776 | A * | 4/1996 | Huru | A63B 60/50 473/563 |
| 5,575,724 | A | 11/1996 | Hannon et al. | |
| 5,577,725 | A | 11/1996 | Pagotto et al. | |
| 5,720,388 | A | 2/1998 | King et al. | |
| D418,182 | S | 12/1999 | Krist | |
| D421,782 | S | 3/2000 | Ryu | |
| D430,249 | S | 8/2000 | Burger | |
| D431,273 | S | 9/2000 | Burger | |

(Continued)

FOREIGN PATENT DOCUMENTS

| | | |
|---|---|---|
| BE | 901416 A2 | 4/1985 |
| CA | 933965 A | 9/1973 |

(Continued)

*Primary Examiner* — Mark S Graham

(74) *Attorney, Agent, or Firm* — Banner & Witcoff, Ltd.

(57) ABSTRACT

A construct for a hockey stick that includes a shaft having with variable cross-sectional geometry. The shaft may include one or more portions with pentagonal and heptagonal cross-sections that increase the bending stiffness of the hockey stick shaft.

13 Claims, 19 Drawing Sheets

(56) References Cited

U.S. PATENT DOCUMENTS

| | | | | |
|---|---|---|---|---|
| D432,610 | S | 10/2000 | Barila | |
| 6,267,697 | B1 | 7/2001 | Sulenta | |
| D458,329 | S | 6/2002 | Clark, Jr. et al. | |
| D476,049 | S | 6/2003 | Sultenta | |
| D484,555 | S | 12/2003 | Bellefleur et al. | |
| 6,820,654 | B2 | 11/2004 | Lindsay | |
| D504,166 | S | 4/2005 | Bellefleur et al. | |
| D504,929 | S | 5/2005 | Bellefleur et al. | |
| 6,953,405 | B2 | 10/2005 | LeMire et al. | |
| 6,955,619 | B1 * | 10/2005 | Schutz | A63B 59/70 473/560 |
| 7,008,687 | B2 | 3/2006 | Wang | |
| D534,227 | S | 12/2006 | Lee | |
| 7,201,678 | B2 | 4/2007 | Filice et al. | |
| D544,932 | S | 6/2007 | Scott | |
| 7,285,063 | B2 | 10/2007 | Lussier et al. | |
| 7,331,876 | B2 | 2/2008 | Klein | |
| D565,140 | S | 3/2008 | Appleton et al. | |
| 7,404,775 | B2 | 7/2008 | Morrow et al. | |
| D581,474 | S | 11/2008 | Dickie et al. | |
| D581,475 | S | 11/2008 | Dickie et al. | |
| D589,099 | S | 3/2009 | Purnell | |
| D589,101 | S | 3/2009 | Dickie et al. | |
| D589,102 | S | 3/2009 | Dickie et al. | |
| D594,516 | S | 6/2009 | Giblin | |
| D594,920 | S | 6/2009 | Drouin et al. | |
| D595,368 | S | 6/2009 | Drouin et al. | |
| D595,792 | S | 7/2009 | Drouin et al. | |
| 7,584,571 | B2 | 9/2009 | Ryan | |
| 7,614,969 | B2 | 11/2009 | Meyer et al. | |
| 7,651,418 | B2 | 1/2010 | Appleton et al. | |
| D610,641 | S | 2/2010 | Solin | |
| 7,931,549 | B2 | 4/2011 | Pearson et al. | |
| D654,129 | S | 2/2012 | Garcia et al. | |
| D688,342 | S | 8/2013 | Tucker, Jr. et al. | |
| D752,167 | S | 3/2016 | Chorne | |
| 9,283,454 | B2 | 3/2016 | Bond | |
| D770,581 | S | 11/2016 | Gosselin | |
| D775,289 | S | 12/2016 | Crouchen | |
| 9,757,631 | B2 | 9/2017 | Lacey et al. | |
| D808,480 | S | 1/2018 | Plug | |
| D808,481 | S | 1/2018 | Plug | |
| 2001/0046909 | A1 * | 11/2001 | Pagotto | A63B 59/70 473/563 |
| 2004/0087395 | A1 | 5/2004 | Manory | |
| 2005/0130759 | A1 | 6/2005 | Hayden et al. | |
| 2005/0176529 | A1 * | 8/2005 | Frischmon | B27M 3/22 473/560 |
| 2005/0187046 | A1 * | 8/2005 | Kavanaugh | A63B 60/08 473/560 |
| 2005/0215364 | A1 | 9/2005 | Lussier et al. | |
| 2006/0046866 | A1 | 3/2006 | Rigoli | |
| 2011/0028250 | A1 | 2/2011 | Pearson et al. | |
| 2011/0237363 | A1 | 9/2011 | Chang | |
| 2012/0193021 | A1 | 8/2012 | Botten et al. | |
| 2017/0246519 | A1 | 8/2017 | Lacey et al. | |

FOREIGN PATENT DOCUMENTS

| | | | | |
|---|---|---|---|---|
| CA | 1151693 | A | 8/1983 | |
| CA | 2106178 | A1 * | 3/1995 | A63B 59/70 |
| CA | 2506213 | A1 | 11/2005 | |
| CA | 2674172 | C | 2/2014 | |
| CA | 2793353 | A1 | 4/2014 | |
| CA | 2954993 | A1 | 1/2016 | |
| WO | WO-2017052675 | A1 * | 3/2017 | A63B 59/70 |

* cited by examiner

HOCKEY STICK WITH VARIABLE STIFFNESS SHAFT

FIELD

This disclosure relates generally to fabrication of molded structures. More particularly, aspects of this disclosure relate to molded hockey shafts having non-uniform cross-sectional geometries along the shaft length, as well as hockey stick blades molded from foam and wrapped with one or more layers of tape.

BACKGROUND

Hockey stick shafts may be constructed from one or more layers of synthetic materials, such as fiberglass, carbon fiber or Aramid. Aspects of this disclosure relate to improved methods for production of a hockey stick shaft with increased bending stiffness and/or decreased mass.

SUMMARY

This Summary is provided to introduce a selection of concepts in a simplified form that are further described below in the Detailed Description. The Summary is not intended to identify key features or essential features of the claimed subject matter, nor is it intended to be used to limit the scope of the claimed subject matter.

Aspects of the disclosure herein may relate to fabrication of a formed hockey stick structure. In one example, the formed hockey stick structure may include shaft that has a variable cross-sectional geometry. A method of fabricating a formed hockey stick structure that has variable shaft geometry may include forming a shaft structure. The formation of the shaft structure may include wrapping a mandrel with fiber tape to form a wrapped shaft structure, removing the mandrel from the wrapped shaft structure to form an internal shaft cavity, and inserting an inflatable bladder into the shaft cavity. The wrapped shaft structure may be positioned within a mold, and the mold may be heated and the bladder may be expanded within the cavity to exert an internal pressure on the cavity to urge the fiber tape toward the walls of the mold. The mold may be cooled and the bladder contracted and removed. The method of fabricating a formed hockey stick structure may additionally include forming a hockey stick blade structure, and coupling the shaft structure to the blade structure. The walls of the mold may impart an outer geometry on the shaft structure that includes a portion having a cross-sectional geometry with at least five sides along a length of the shaft structure.

BRIEF DESCRIPTION OF THE DRAWINGS

The present disclosure is illustrated by way of example and not limited in the accompanying figures in which like reference numerals indicate similar elements and in which.

Further, it is to be understood that the drawings may represent the scale of different component of one single embodiment; however, the disclosed embodiments are not limited to that particular scale.

DETAILED DESCRIPTION

In the following description of various example structures, reference is made to the accompanying drawings, which form a part hereof, and in which are shown by way of illustration various embodiments in which aspects of the disclosure may be practiced. Additionally, it is to be understood that other specific arrangements of parts and structures may be utilized, and structural and functional modifications may be made without departing from the scope of the present disclosures. Also, while the terms "top" and "bottom" and the like may be used in this specification to describe various example features and elements, these terms are used herein as a matter of convenience, e.g., based on the example orientations shown in the figures and/or the orientations in typical use. Nothing in this specification should be construed as requiring a specific three-dimensional or spatial orientation of structures in order to fall within the scope of this invention.

Aspects of this disclosure relate to systems and methods for production of a hockey stick structure using variable cross-sectional geometries.

Figure 1:
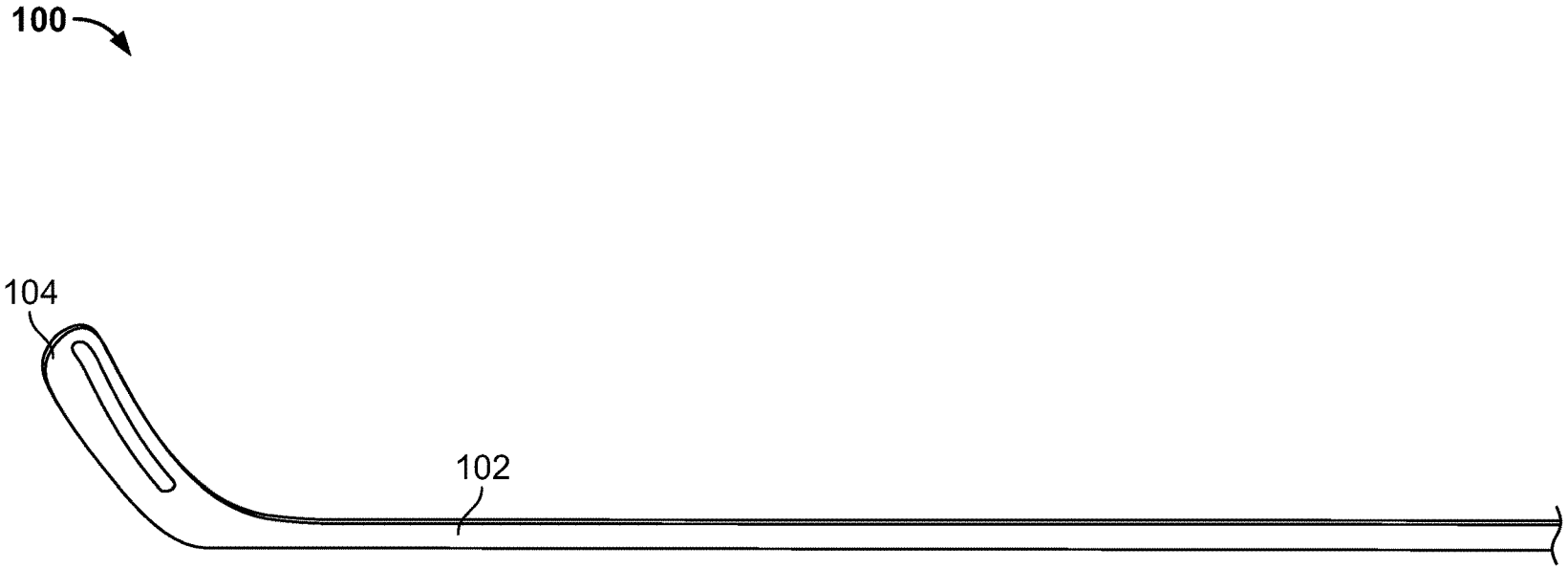
FIG. 1 depicts a front side of a hockey stick structure, according to one or more aspects described herein.

FIG. 1 depicts a front side of a hockey stick structure 100, according to one or more aspects described herein. In one example, the hockey stick structure 100 includes a shaft structure 102 that is rigidly coupled to a blade structure 104. In one example, the shaft structure 102 may include a hollow structure formed from one or more fiber-reinforced materials. For example, the shaft structure 102 may be formed from a carbon fiber material. The shaft structures described throughout this disclosure may use materials in addition to or as an alternative to carbon fiber, including fiberglass, Aramid, and/or other composite or fiber-reinforced materials, among others. It is further contemplated that any of the structures described throughout these disclosures may use one or more materials in a tape form, or formed as discrete elements prior to one or more molding processes. Additionally or alternatively, the tape of discrete elements, and may be preimpregnated with resin or another adhesive, or may have resin or another adhesive applied to the tape and/or discrete pieces. In one specific implementation, the shaft structure 102 may be formed from one or more layers of carbon fiber tape that are preimpregnated with resin and heated and cooled in a mold in order to impart the desired geometries of the final shaft structure 102. Additionally, the shaft structure 102 may include one or more internal foam core structures around which the fiber tape is wrapped and molded in order to give the shaft structure 102 its final form. The blade structure 104 may be molded separately to the shaft structure 102, and subsequently rigidly coupled to the shaft structure 102. Alternatively, the blade structure 104 may be co-molded with the shaft structure 102.

Figure 2:
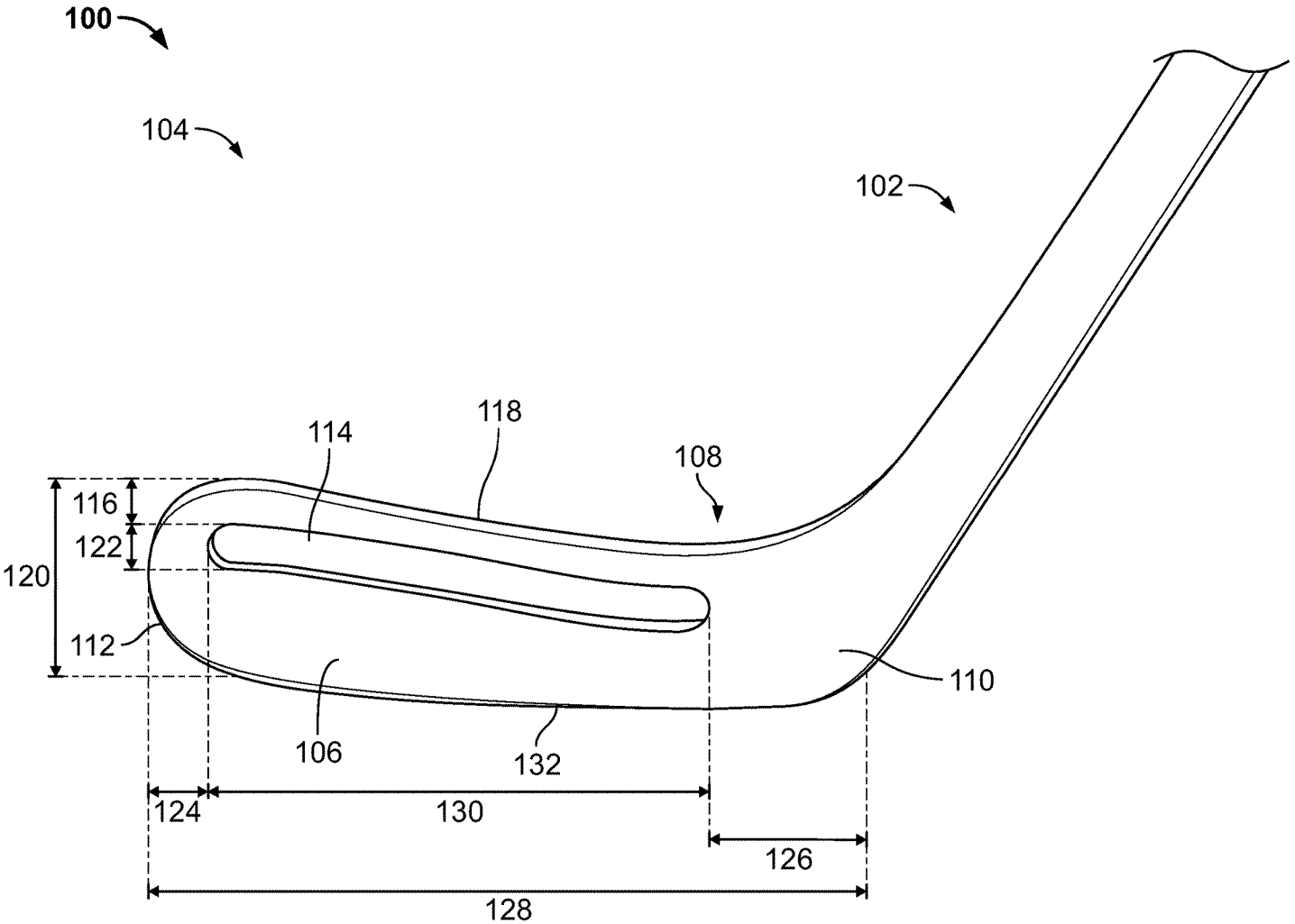
FIG. 2 depicts a more detailed view of a front side of the hockey stick blade structure and a portion of the shaft structure of FIG. 1, according to one or more aspects described herein.
Figure 3:
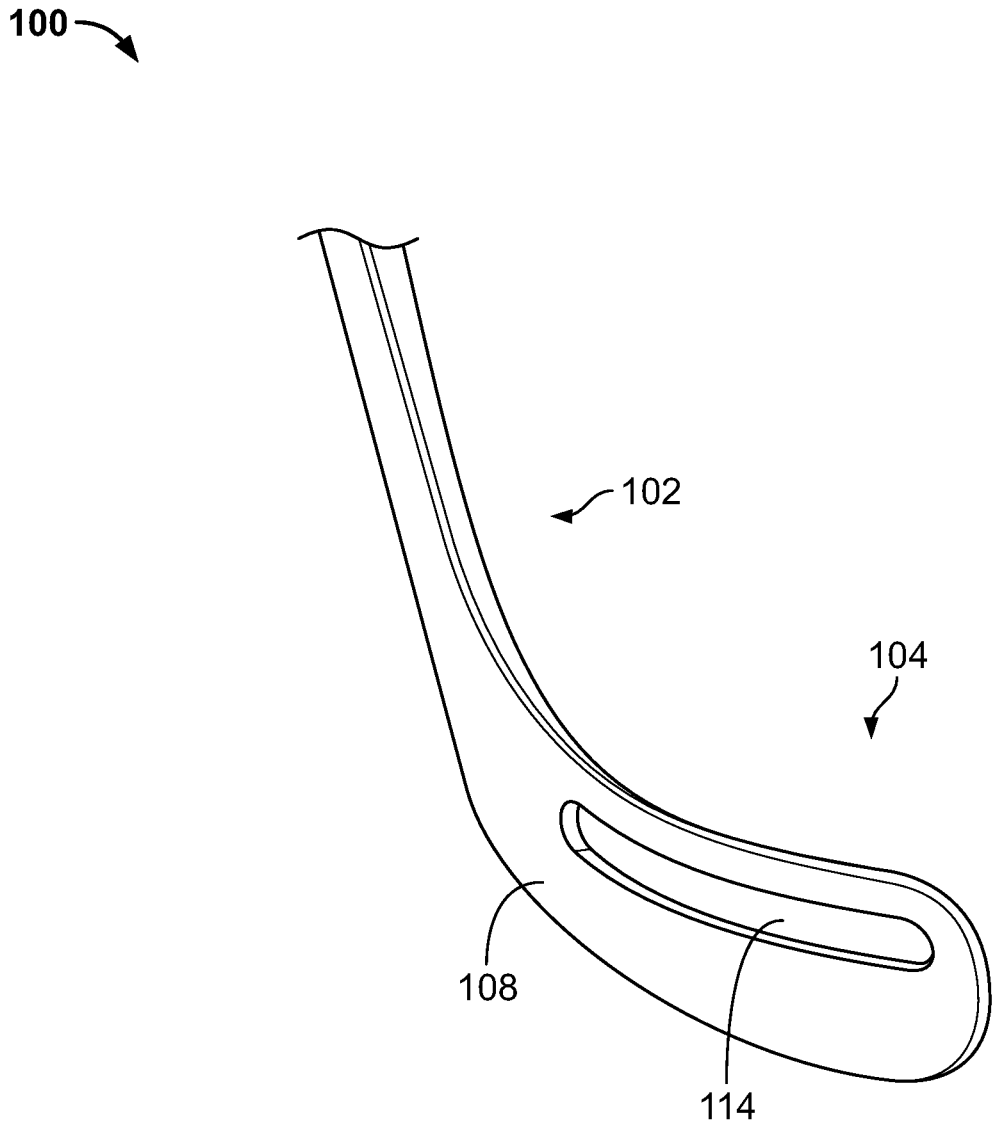
FIG. 3 depicts a more detailed view of a back side of the hockey stick blade structure and a portion of the shaft structure of FIG. 1, according to one or more aspects described herein.

FIG. 2 depicts a more detailed view of a front side of the hockey stick blade structure 104 and a portion of the shaft structure 102, according to one or more aspects described herein. Further, FIG. 3 depicts a more detailed view of a back side of the hockey stick blade structure 104 and a portion of the shaft structure 102, according to one or more aspects described herein. In one example, the blade structure 104 may be formed from one or more layers of fiber reinforced material, similar to the shaft structure 102. In particular, the blade structure 104 may be formed from one or more layers of carbon fiber tape that are preimpregnated with resin, and wrapped around a foam core before being heated and cooled in a mold to form the desired geometries of the final blade structure 104. Additionally, the blade structure 104 may include one or more fiber pins extending through one or more layers of fiber tape and an internal foam core of the blade structure 104 between a front face 106 and a back face 108. Advantageously, the pins, when molded along with the fiber tape of the blade structure 104, may reinforce the blade structure 104.

Additionally, the blade structure 104 may include a slot 114 that extends through the blade from the front face 106 to the back face 108, and extends along a portion of a length of the hockey stick blade structure 104 between a heel side 110 and a toe side 112 of the blade structure 104. In one example, the slot 114 may be positioned at a distance 116 from a top edge 118 of the blade structure 104. In another example, the slot 114 may be substantially parallel to the top edge 118 of the blade structure 104. The distance 116 may range between 10 mm and 20 mm. Additionally or alternatively, distance 116 may be a percentage of an overall blade height 120. It is further contemplated, however, that the distance 116 may have any value, without departing from the scope of these disclosures. Similarly, the slot 114 may have a slot height 122. This slot height 122 may range between 2 mm and 20 mm and/or may be a percentage of the overall blade height 120. Further, the slot 114 may be positioned at a distance 124 from the toe side 112 of the blade structure 104, and at a distance 126 from the heel side 110 of the blade structure 104. Distance 124 and distance 126 may range between 15 mm and 80 mm and between 20 mm and 150 mm, respectively, and/or may each be a percentage of an overall blade length 128. As such, the slot 114 may have a length 130 that measures between 70 mm and 270 mm, and/or as a percentage of the overall blade length 128.

Advantageously, the slot 114 may reduce the mass of the blade structure 104. Additionally or alternatively, the slot 114 may allow more material to be added to the blade structure 104 toward the bottom edge 132 prior to molding. As such, the slot 114 may essentially allow the mass in the blade 104 to be shifted toward the bottom edge 132. This additional material may include added layers of fiber tape used prior to molding, and/or one or more inserts being used within the blade structure 104. This additional material/structural elements may increase the hardness, and hence the durability, of the bottom edge 132 of the blade structure 104 and/or the overall strength and stiffness of the blade 104.

Figure 4:
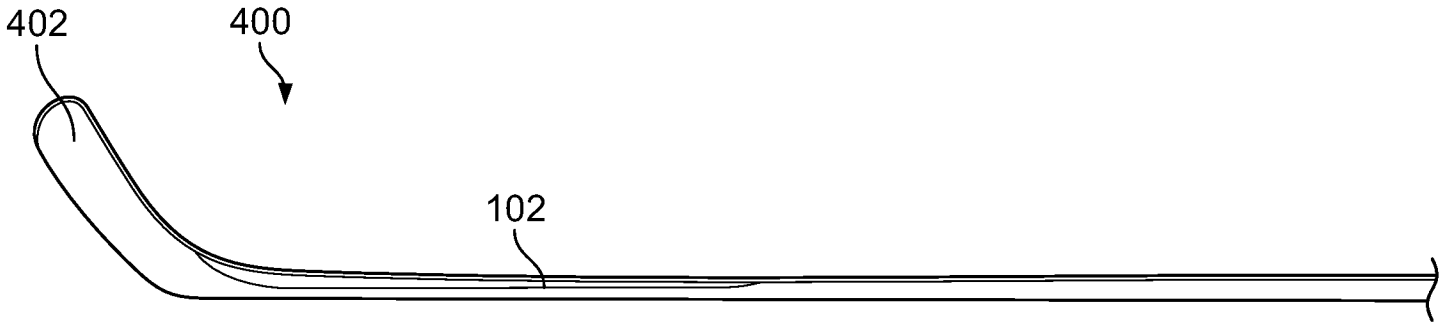
FIG. 4 depicts a front side of a hockey stick structure, according to one or more aspects described herein.

FIG. 4 depicts a front side of a hockey stick structure 400, according to one or more aspects described herein. In one example, the hockey stick structure 400 may include a shaft structure 102 similar to that of a hockey stick structure 100, as previously described. The hockey stick structure 400 may additionally include a blade structure 402 that may be co-molded with the shaft structure 102, or may be formed as a separate structure and rigidly coupled to the shaft structure 102. It is contemplated that the blade structure 402 may be formed using one or more molding processes similar to those of blade structure 104, as described in relation to hockey stick structure 100. Accordingly, the blade structures 104 and 402 may include any hockey blade curve geometries. Additionally, the blade structures 104 and 402 may include pin reinforcement elements that are inserted into a foam core of the blade structures 104 and 402 prior to one or more molding processes. These pin reinforcement elements are described further in U.S. patent application Ser. No. 15/280,603, filed 26 Sep. 2016, the entire contents of which is incorporated herein by reference in its entirety for any and all non-limiting purposes.

In one example, shaft structure 102 may include a variable cross-sectional geometry that is configured to provide a prescribed variable stiffness along the length of the shaft. Advantageously, the variable cross-sectional geometry may allow the hockey stick shaft 102 to be constructed using less material, while still maintaining a desired and high flexural rigidity. In particular, the variable cross-sectional geometry may allow the stick shaft 102 to be constructed using comparatively fewer layers of fiber tape and/or using comparatively fewer or no reinforcement inserts within the hollow core of the stick shaft 102 This decreased amount of material may result in a hockey stick structure 100 and/or 400 having a comparatively reduced mass when compared with a hockey stick constructed using conventional methods.

In another example, the mass of the hockey stick structure 100 and/or 400 may be reduced when compared to a conventional hockey stick structure that includes a shaft having a rectangular cross-sectional geometry. However, the hockey stick structures 100 and/or 400 may use an increased number of lighter fiber layers when compared to a conventional hockey stick structure. In one example, a conventional hockey stick shaft may include 8-13 fiber layers that result in a total mass of a stick being approximately 422 grams. However, the hockey stick structure 100 and/or 400 may use 11-20 layers, but a total mass of a stick may be approximately 376 grams. In certain examples, the mass of hockey stick structures 100 and/or 400 may be reduced by 7-20% relative to conventional hockey stick structures. In other examples, the processes described herein may be used to reduce the mass of a hockey stick by 25-30% or more, when compared to a similar hockey stick constructed using conventional methodologies. In certain examples, the fiber layers used to construct the hockey stick structures 100 and/or 400 may have low densities than fiber layers used in conventional hockey stick structures. As a result, the hockey stick structures 100 and/or 400 may use an increased number of fiber layers, but have a resultant mass that is lower than conventional hockey stick structures due to the comparatively lower material densities. It is contemplated that any material densities may be used for the fiber layers of hockey stick structures 100 and/or 400, without departing from the scope of these disclosures.

Advantageously, an increased number of fiber layers may result in a stronger hockey stick structure since the layers may be oriented relative to one another, such that any mechanical properties (e.g., strength, hardness, stiffness, among others) that are greater along one axis or a limited number of axes of a given layer of fiber tape (e.g., an anisotropic material) may result in an aggregate layered material with increased mechanical properties in multiple directions (in one example this methodology may be used to form a hockey stick structure that tends toward an isotropic material). In other examples, the increased number of fiber layers of the hockey stick structures 100 and/or 400 may be used to impart one or more structural properties in one direction, and one or more different structural properties in a second direction.

In particular, the hockey stick shaft 102 may be considered a beam subject to a bending force during a shooting or passing motion (e.g. a slap shot, wrist shot among others). The flexural rigidity, or "bending stiffness" of a hockey stick shaft includes two components, and is given by the formula:

$$\text{Flexural rigidity}=E\cdot I \qquad \text{(Equation 1)}$$

From Equation 1, E represents a contribution of the material of the hockey stick shaft 102 to the flexural rigidity. E is the Young's Modulus, or elastic modulus, and is a measure of the stiffness of a hockey stick shaft 102. E has SI units of Pascals (Pa).

Also from Equation 1, I represents a contribution of the cross-sectional geometry of the hockey stick shaft 102 to the flexural rigidity. I is the Second Moment of Inertia, or Second Moment of Area, and is a measure of the efficiency of a shape to resist bending. I has SI units of m^4.

With reference to Equation 1, the hockey stick shaft 102 is configured to increase the Second Moment of Area, I, component of the flexural rigidity by using a non-standard cross-sectional geometry. In certain examples, the hockey stick shaft 102 may be configured with a cross-sectional geometry that varies along a length of the shaft 102, and thereby varies the flexural rigidity of the shaft 102 with position along the shaft's length. Advantageously, this may allow a the hockey stick shaft 102 to be manufactured with flexing characteristics that are tuned to a specific position type, player type (weight, height, strength, among others) or a specific player (e.g. a specific professional player).

In one example, increasing the Second Moment of Area, I, may allow the Young's Modulus, E, to be decreased, while maintaining a same overall flexural rigidity. In one example, the Young's Modulus, E, may be decreased by reducing an amount of material used to form all or part of the hockey stick shaft 102, and hence, reducing the overall mass of the hockey stick shaft 102.

Figure 5:
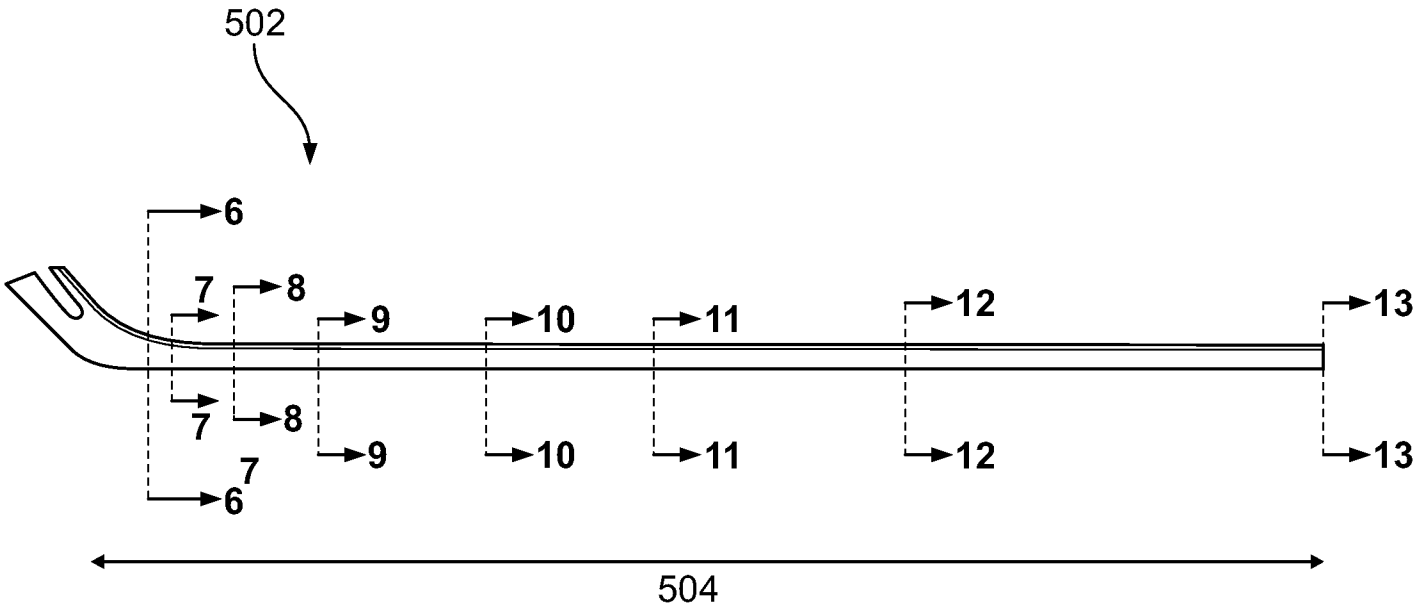
FIG. 5 depicts an example hockey stick shaft, according to one or more aspects described herein.

In one implementation, the Second Moment of Area, I, of the hockey stick shaft 102 may be increased by using a non-rectangular cross-sectional geometry. Specifically, the hockey stick shaft 102 may include portions with pentagonal and/or heptagonal cross-sectional geometries. FIG. 5 schematically depicts an example hockey stick shaft 502, according to one or more aspects described herein. In one implementation, the hockey stick shaft 502 may include one or more portions with pentagonal (5-sided) geometries. It is contemplated that the cross-sectional geometry of hockey stick shaft 502 may vary along the longitudinal length 504. In this regard, multiple cross-sections of the hockey stick shaft 502 are provided in FIGS. 6-13, as described in the following portions of this disclosure. However, FIGS. 6-13 refer to one implementation of variable cross-sectional geometry of hockey stick shaft 502, and it is contemplated that alternative cross-sectional geometries may be used, without departing from the scope of these disclosures. In one example, as described in relation to FIGS. 6-13, the hockey stick shaft 502 may include a first portion with a first cross-sectional geometry and a second portion with a second cross-sectional geometry. The first cross-sectional geometry may be pentagonal in shape, and the second cross-sectional geometry may have another pentagonal cross-sectional geometry, or may be rectangular in shape. It is contemplated that the description of the various geometries used throughout these disclosures may be refer to geometries with rounded edges/corners, such that pentagonal and a rectangular geometries may have respective five and four sides with rounded corners with any radius of curvature. It is further contemplated that the geometries may or may not have two or more sides of equal length. Additionally, it is contemplated that the sides of the various cross-sectional geometries may have inner and/or outer surfaces that are substantially planar, or may be partially uneven, including convex and/or concave geometries.

FIGS. 6-13 include various dimensional values. As such, it is contemplated that these dimensions may be implemented with any values, without departing from the scope of these disclosures. It is further contemplated that the hockey stick shaft 502 may have increased bending stiffness when compared to a conventional shaft that uses rectangular cross sections. This increased bending stiffness may result from non-standard pentagonal geometry, without an increase in Young's modulus, E, resulting from an increased material/shaft wall thickness, and the like. In another example, an increase in bending stiffness may result from a combination of increased second moment of inertia, I, and Young's Modulus, E.

Figure 6:
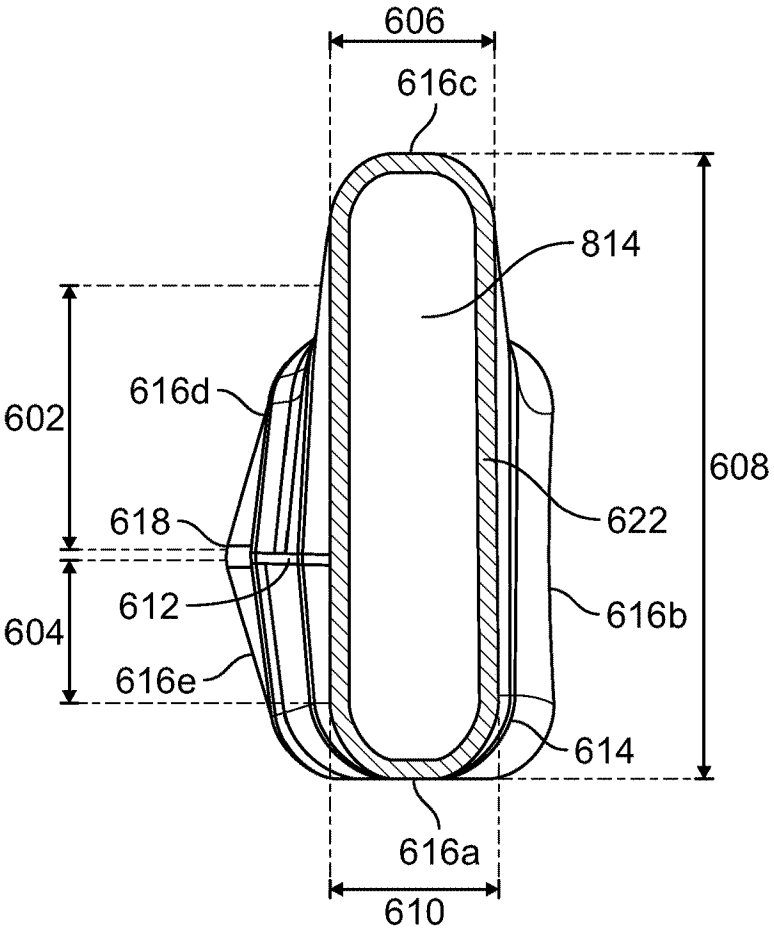

FIG. 6 schematically depicts a cross-sectional view corresponding to arrows 6-6 from FIG. 5, according to one or more aspects described herein. In one example, the cross section of FIG. 6 includes five sides 616*a*-616*e*. The cross-section includes an apex 618 formed at the intersection of side 616*d* and 616*e*. This apex 618 is positioned on the back of the hockey stick shaft 502, and the side 616*b* provides a substantially flat surface on the front of the hockey stick shaft 502. The cross-section of FIG. 6 additionally depicts carbon-fiber walls 622 that surround the internal cavity 814. In one specific implementation, the cross-section of FIG. 6 includes the following specific dimensional values, such that length 602 may equal 0.671 inches. In another example, length 602 may range between 0.6 and 0.8 inches, among others. Length 604 may equal 0.362 inches. In another example, length 604 may range between 0.3 and 0.5 inches, among others. Length 610 may equal to 0.458 inches. In another example, length 610 may range between 0.4 and 0.6 inches, among others. Length 608 may equal 1.671 inches. In another example, length 608 may range between 1.5 and 1.8 inches, among others. Length 606 may equal 0.445 inches. In another example, length 606 may range between 0.35 and 0.6 inches, among others. The radius of curvature 618 may equal 0.12 inches. In another example, the radius of curvature 618 may range between 0.08 and 0.16 inches. The radius of curvature 614 may equal 0.197 inches. In another example, the radius of curvature 614 may range between 0.18 and 0.21 inches.

Figure 7:
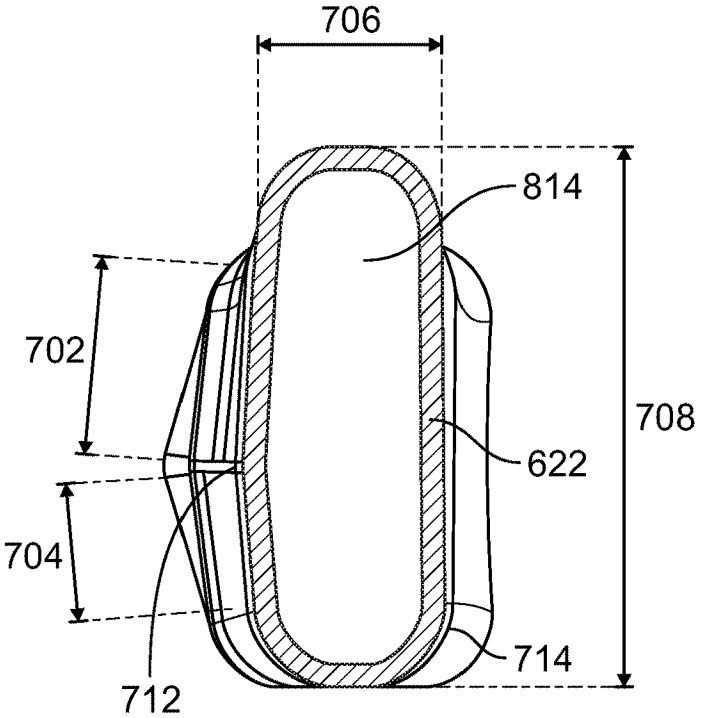
FIGS. 6-13 schematically depict cross-sectional views of the hockey stick shaft of FIG. 5, according to one or more aspects described herein.

FIG. 7 schematically depicts a cross-sectional view corresponding to arrows 7-7 from FIG. 5, according to one or more aspects described herein. In one example, the cross section of FIG. 7 includes five sides, similar to FIG. 6. The cross-section of FIG. 7 additionally depicts carbon-fiber walls 622 that surround an internal cavity 814. In one specific implementation, the cross-section of FIG. 7 includes the following specific dimensional values, such that length 702 may equal 0.532 inches. In another example, length 702 may range between 0.5 and 0.6 inches, among others. Length 704 may equal 0.365 inches. In another example, length 704 may range between 0.3 and 0.5 inches, among others. Length 706 may equal to 0.531 inches. In another example, length 706 may range between 0.4 and 0.65 inches, among others. Length 708 may equal 1.437 inches. In another example, length 708 may range between 1.3 and 1.55 inches, among others. The radius of curvature 712 may equal 0.12 inches. In another example, the radius of curvature 712 may range between 0.08 and 0.16 inches, among others. The radius of curvature 714 may equal 0.206 inches. In another example, the radius of curvature 714 may range between 0.19 and 0.22 inches, among others.

Figure 8:
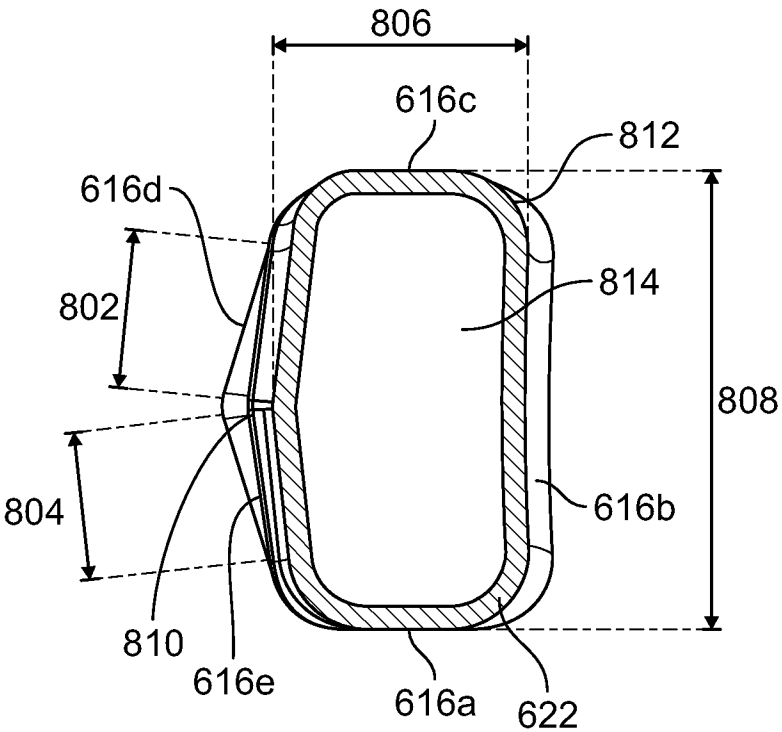

FIG. 8 schematically depicts a cross-sectional view corresponding to arrows 8-8 from FIG. 5, according to one or more aspects described herein. In one example, the cross section of FIG. 8 includes five sides, similar to FIG. 6. The cross-section of FIG. 8 additionally depicts an internal cavity 814 formed within the carbon-fiber walls 622. In one example, the internal cavity 814 may have a substantially rectangular cross-sectional shape. In another example, the internal cavity 814 may have a substantially pentagonal shape, such that the thickness of the sidewall 622 is substantially uniform around the perimeter of the hollow shaft 502. It is further contemplated that the internal cavity 814 may have additional or alternative cross sectional geometries in addition to or as alternatives to the pentagonal and/or rectangular geometries described herein. In one specific implementation, the cross-section of FIG. 8 includes the following specific dimensional values, such that length 802 may equal 0.412 inches. In another example, length 802 may range between 0.39 and 0.43 inches, among others. Length 804 may equal 0.393 inches. In another example, length 804 may range between 0.37 and 0.42 inches, among others. Length 806 may equal to 0.681 inches. In another example, length 806 may range between 0.6 and 0.8 inches, among others. Length 808 may equal 1.21 inches. In another example, length 808 may range between 1.1 and 1.4 inches, among others. The radius of curvature 810 may equal 0.12 inches. In another example, the radius of curvature 810 may range between 0.08 and 0.16 inches, among others. The radius of curvature 812 may equal 0.216 inches. In another example, the radius of curvature 812 may range between 0.19 and 0.24 inches, among others.

Figure 9:
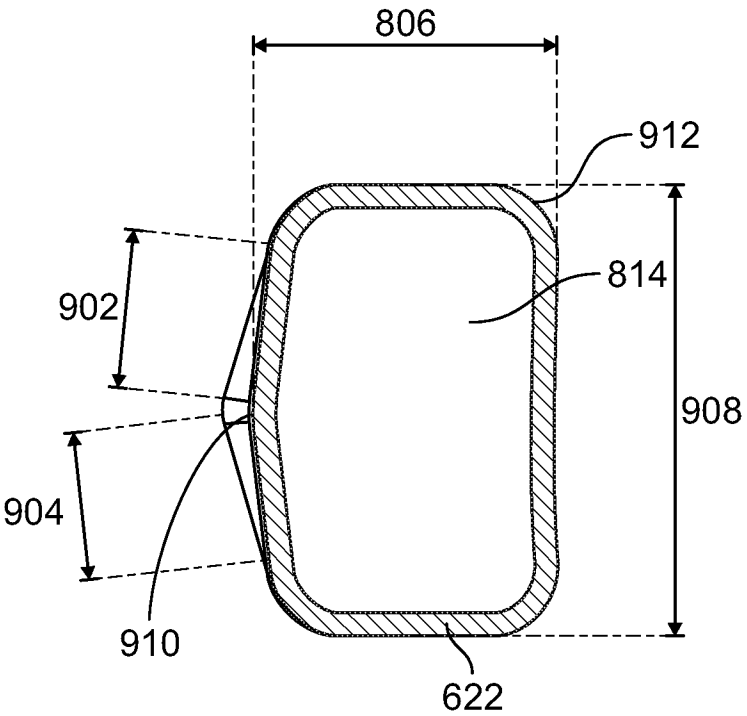

FIG. 9 schematically depicts a cross-sectional view corresponding to arrows 9-9 from FIG. 5, according to one or more aspects described herein. In one example, the cross section of FIG. 9 includes five sides, similar to FIG. 6. The cross-section of FIG. 9 additionally depicts an internal cavity 814 formed within the carbon-fiber walls 622. In one specific implementation, the cross-section of FIG. 8 includes the following specific dimensional values, such that length 902 may equal 0.402 inches. In another example, length 902 may range between 0.38 and 0.43 inches, among others. Length 904 may equal 0.405 inches. In another example, length 904 may range between 0.38 and 0.43 inches, among others. Length 906 may equal to 0.795 inches. In another example, length 906 may range between 0.7 and 0.9 inches, among others. Length 908 may equal 1.174 inches. In another example, length 908 may range between 1.0 and 1.3 inches, among others. The radius of curvature 910 may equal 0.12 inches. In another example, the radius of curvature 910 may range between 0.08 and 0.16 inches, among others. The radius of curvature 912 may equal 0.197 inches. In another example, the radius of curvature 912 may range between 0.18 and 0.22 inches, among others.

Figure 10:
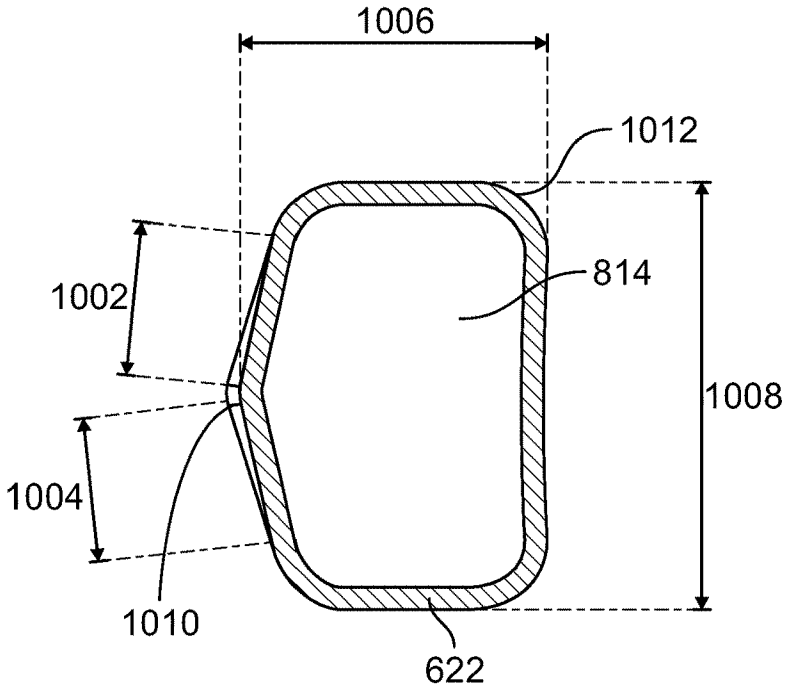

FIG. 10 schematically depicts a cross-sectional view corresponding to arrows 10-10 from FIG. 5, according to one or more aspects described herein. In one example, the cross section of FIG. 10 includes five sides, similar to FIG. 6. The cross-section of FIG. 10 additionally depicts an internal cavity 814 formed within the carbon-fiber walls 622. In one specific implementation, the cross-section of FIG. 10 includes the following specific dimensional values, such that length 1002 may equal 0.388 inches. In another example, length 1002 may range between 0.37 and 0.42 inches, among others. Length 1004 may equal 0.388 inches. In another example, length 1004 may range between 0.37 and 0.42 inches, among others. Length 1006 may equal to 0.842 inches. In another example, length 1006 may range between 0.7 and 1.0 inches, among others. Length 1008 may equal 1.168 inches. In another example, length 1008 may range between 1.0 and 1.3 inches, among others. The radius of curvature 1010 may equal 0.12 inches. In another example, the radius of curvature 1010 may range between 0.08 and 0.16 inches, among others. The radius of curvature 1012 may equal 0.197 inches. In another example, the radius of curvature 1012 may range between 0.18 and 0.22 inches, among others.

Figure 11:
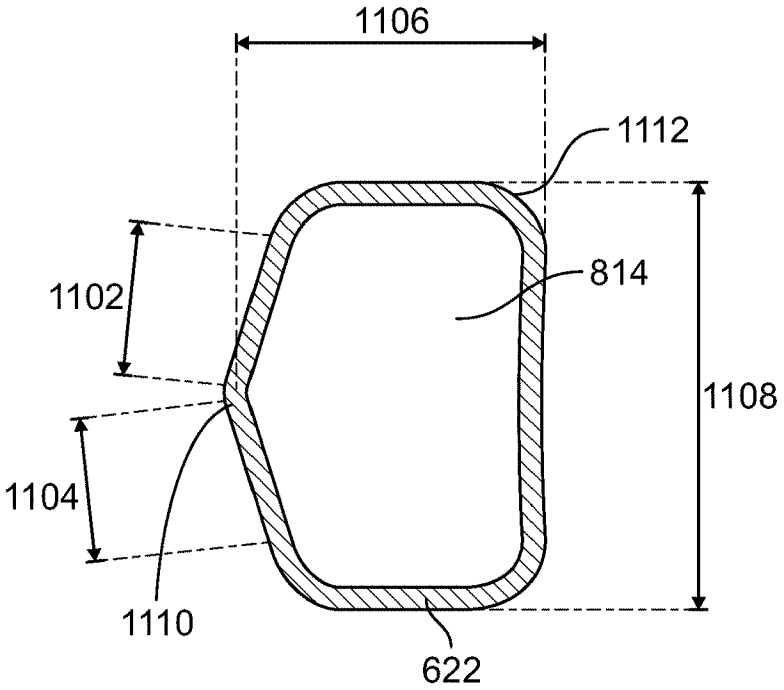

FIG. 11 schematically depicts a cross-sectional view corresponding to arrows 11-11 from FIG. 5, according to one or more aspects described herein. In one example, the cross section of FIG. 11 includes five sides, similar to FIG. 6. The cross-section of FIG. 11 additionally depicts an internal cavity 814 formed within the carbon-fiber walls 622. In one specific implementation, the cross-section of FIG. 11 includes the following specific dimensional values, such that length 1102 may equal 0.389 inches. In another example, length 1102 may range between 0.37 and 0.42 inches, among others. Length 1104 may equal 0.389 inches. In another example, length 1104 may range between 0.37 and 0.42 inches, among others. Length 1106 may equal to 0.864 inches. In another example, length 1106 may range between 0.7 and 1.0 inches, among others. Length 1108 may equal 1.165 inches. In another example, length 1108 may range between 1.0 and 1.3 inches, among others. The radius of curvature 1110 may equal 0.12 inches. In another example, the radius of curvature 1110 may range between 0.08 and 0.16 inches, among others. The radius of curvature 1112 may equal 0.197 inches. In another example, the radius of curvature 1112 may range between 0.18 and 0.22 inches, among others.

Figure 12:
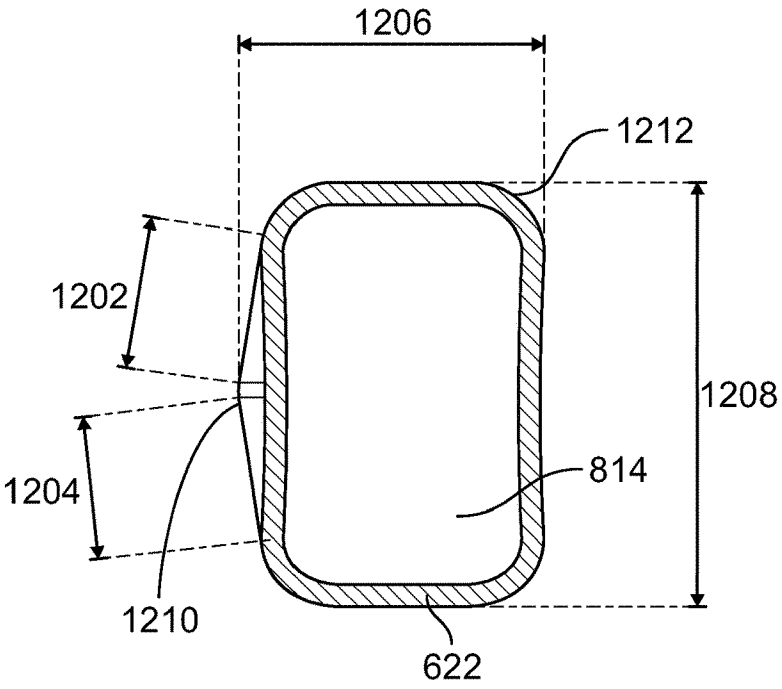

FIG. 12 schematically depicts a cross-sectional view corresponding to arrows 12-12 from FIG. 5, according to one or more aspects described herein. In one example, the cross section of FIG. 12 includes five sides, similar to FIG. 6. The cross-section of FIG. 12 additionally depicts an internal cavity 814 formed within the carbon-fiber walls 622. In one specific implementation, the cross-section of FIG. 12 includes the following specific dimensional values, such that length 1202 may equal 0.384 inches. In another example, length 1202 may range between 0.36 and 0.41 inches, among others. Length 1204 may equal 0.384 inches. In another example, length 1204 may range between 0.36 and 0.41 inches, among others. Length 1206 may equal to 0.819 inches. In another example, length 1206 may range between 0.7 and 1.0 inches, among others. Length 1208 may equal 1.165 inches. In another example, length 1208 may range between 1.0 and 1.3 inches, among others. The radius of curvature 1210 may equal 0.12 inches. In another example, the radius of curvature 1210 may range between 0.08 and 0.16 inches, among others. The radius of curvature 1212 may equal 0.197 inches. In another example, the radius of curvature 1212 may range between 0.18 and 0.22 inches, among others.

Figure 13:
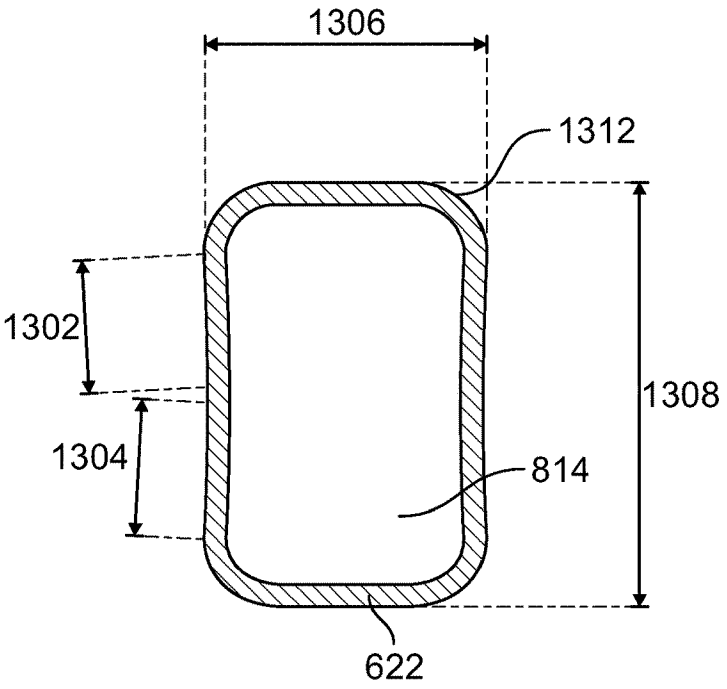

FIG. 13 schematically depicts a cross-sectional view corresponding to arrows 13-13 from FIG. 5, according to one or more aspects described herein. In one example, the cross section of FIG. 13 includes five sides, similar to FIG. 6. The cross-section of FIG. 13 additionally depicts an internal cavity 814 formed within the carbon-fiber walls 622. In one specific implementation, the cross-section of FIG. 13 includes the following specific dimensional values, such that length 1302 may equal 0.358 inches. In another example, length 1302 may range between 0.34 and 0.38 inches, among others. Length 1304 may equal 0.358 inches. In another example, length 1304 may range between 0.34 and 0.38 inches, among others. Length 1306 may equal to 0.756 inches. In another example, length 1306 may range between 0.65 and 1.0 inches, among others. Length 1308 may equal 1.165 inches. In another example, length 1308 may range between 1.0 and 1.3 inches, among others. The radius of curvature 1312 may equal 0.197 inches. In another example, the radius of curvature 1312 may range between 0.18 and 0.22 inches, among others.

Figure 14:
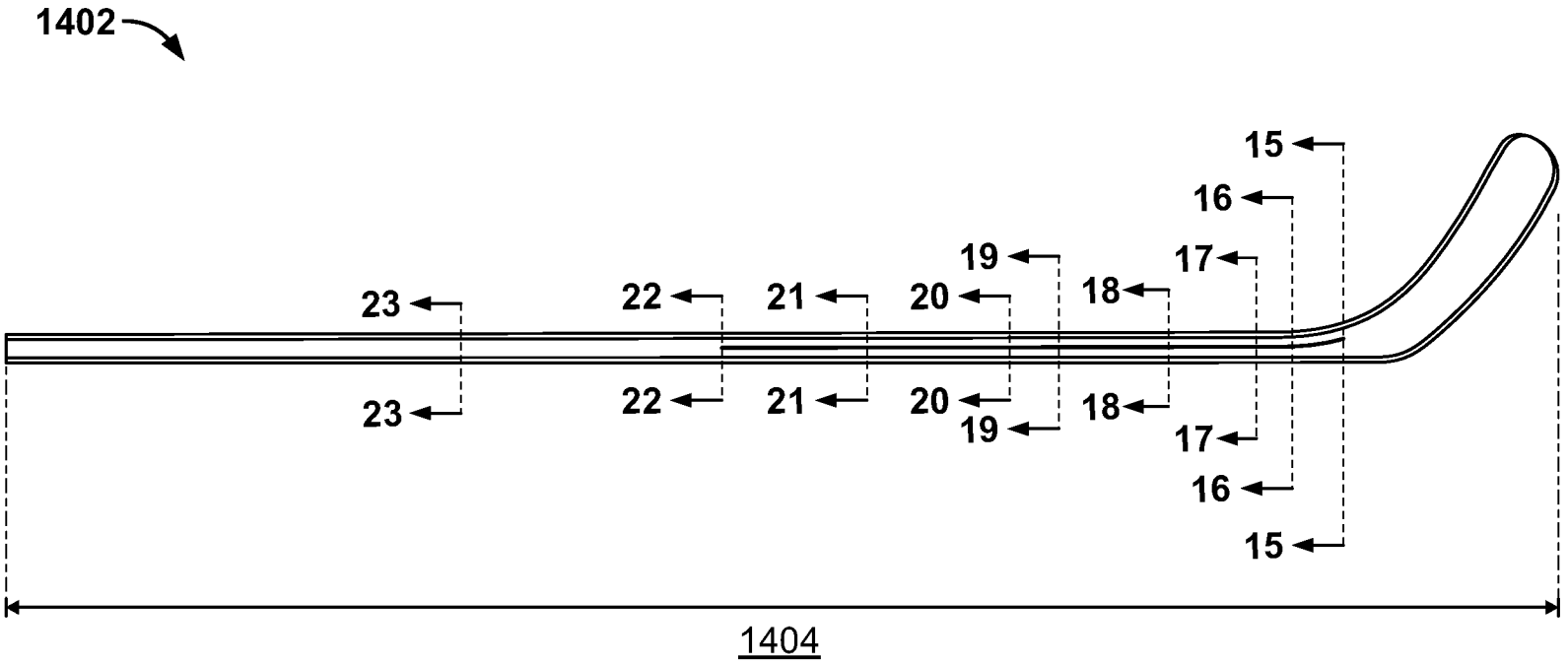
FIG. 14 depicts an example hockey stick shaft, according to one or more aspects described herein.

FIG. 14 depicts an example hockey stick shaft 1402 that may be similar to hockey stick shaft 102. In one implementation, the hockey stick shaft 1402 may include one or more portions with heptagonal (7-sided) geometries. It is contemplated that the cross-sectional geometry of hockey stick shaft 1402 may vary along the longitudinal length 1404. In this regard, multiple cross-sections of the hockey stick shaft 1402 are provided in FIGS. 15-23, as described in the following portions of this disclosure. However, FIGS. 15-23 refer to one implementation of variable cross-sectional geometry of hockey stick shaft 1402, and it is contemplated that alternative cross-sectional geometries may be used, without departing from the scope of these disclosures. In one example, as described in relation to FIGS. 15-23, the hockey stick shaft 1402 may include a first portion with a first cross-sectional geometry and a second portion with a second cross-sectional geometry. The first cross-sectional geometry may be heptagonal in shape, and the second cross-sectional geometry may have another heptagonal cross-sectional geometry, or may be rectangular in shape. It is contemplated that the description of the various geometries used throughout these disclosures may be refer to geometries with rounded edges/corners, such that pentagonal and a rectangular geometries may have respective five and four sides with rounded corners with any radius of curvature. It is further contemplated that the geometries may or may not have two or more sides of equal length. Additionally, it is contemplated that the sides of the various cross-sectional geometries may have inner and/or outer surfaces that are substantially planar, or may be partially uneven, including convex and/or concave geometries.

It is noted that FIGS. 15-23 include various dimensional values. As such, it is contemplated that these dimensions may be implemented with any values, without departing from the scope of these disclosures. It is further contemplated that the hockey stick shaft 1402 may exhibit increased bending stiffness when compared to a conventional shaft that uses rectangular, or rounded rectangular cross sections. This increased bending stiffness may result from non-standard heptagonal geometry, without an increase in Young's Modulus, E, resulting from an increased material/shaft wall thickness, and the like. In another example, an increase in bending stiffness may result from a combination of increased second moment of inertia, I, and Young's Modulus, E.

Figure 15:
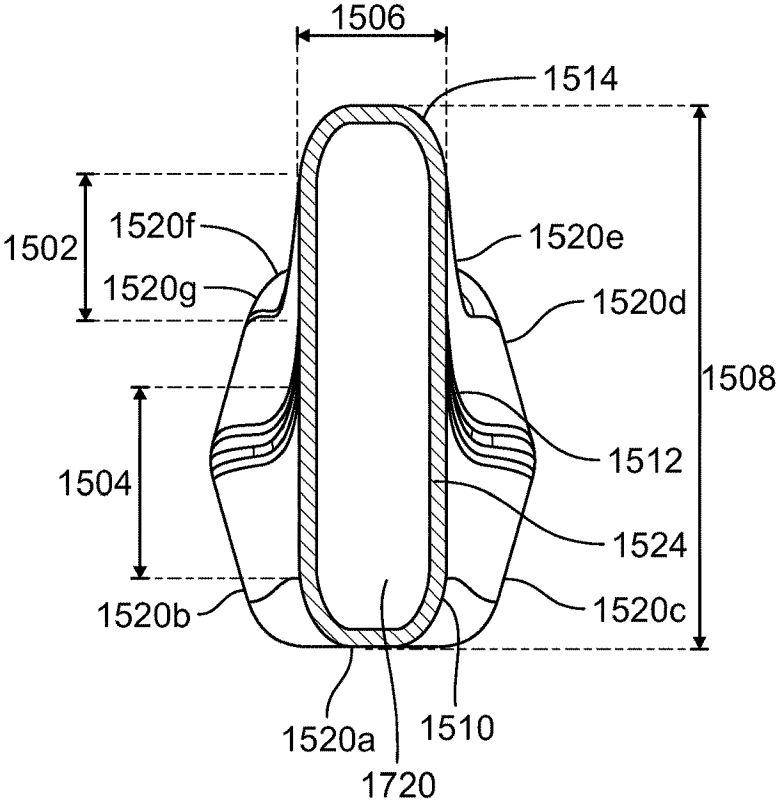

FIG. 15 schematically depicts a cross-sectional view corresponding to arrows 15-15 from FIG. 14, according to one or more aspects described herein. In one example, the cross section of FIG. 15 includes seven sides 1520*a*-1520*g*. The cross-section of FIG. 15 additionally depicts an internal cavity 1720 and carbon-fiber walls 1524 that surround the internal cavity 1720. The walls 1524 may otherwise be referred to as shaft structure sidewalls 1524. In one specific implementation, the cross-section of FIG. 15 includes the following specific dimensional values, such that length 1502 may equal 0.460 inches. In another example, length 1502 may range between 0.35 and 0.6 inches, among others. Length 1504 may equal 0.590 inches. In another example, length 1504 may range between 0.45 and 0.75 inches, among others. Length 1506 may equal 0.457 inches. In another example, length 1506 may range between 0.35 and 0.6 inches, among others. Length 1508 may be 1.675 inches. In another example, length 1508 may range between 1.45 and 1.9 inches, among others. The radius of curvature 1510 may equal 0.216 inches. In another example, the radius of curvature 1510 may range between 0.19 and 0.23 inches. The radius of curvature 1512 may equal 0.16 inches. In another example, the radius of curvature 1512 may range between 0.12 and 0.2 inches. The radius of curvature 1514 may equal 0.197 inches. In another example, the radius of curvature 1514 may range between 0.18 and 0.22 inches.

FIG. 15 schematically depicts a cross-sectional view corresponding to arrows 15-15 from FIG. 14, according to one or more aspects described herein. In one example, the cross section of FIG. 15 includes seven sides 1520*a*-1520*g*. The cross-section of FIG. 15 additionally depicts an internal cavity 1720 and carbon-fiber outer walls 1524 that surround the internal cavity 1720. In one specific implementation, the cross-section of FIG. 15 includes the following specific dimensional values, such that length 1502 may equal 0.460 inches. In another example, length 1502 may range between 0.35 and 0.6 inches, among others. Length 1504 may equal 0.590 inches. In another example, length 1504 may range between 0.45 and 0.75 inches, among others. Length 1506 may equal 0.457 inches. In another example, length 1506 may range between 0.35 and 0.6 inches, among others. Length 1508 may be 1.675 inches. In another example, length 1508 may range between 1.45 and 1.9 inches, among others. The radius of curvature 1510 may equal 0.216 inches. In another example, the radius of curvature 1510 may range between 0.19 and 0.23 inches. The radius of curvature 1512 may equal 0.16 inches. In another example, the radius of curvature 1512 may range between 0.12 and 0.2 inches. The radius of curvature 1514 may equal 0.197 inches. In another example, the radius of curvature 1514 may range between 0.18 and 0.22 inches.

Figure 16:
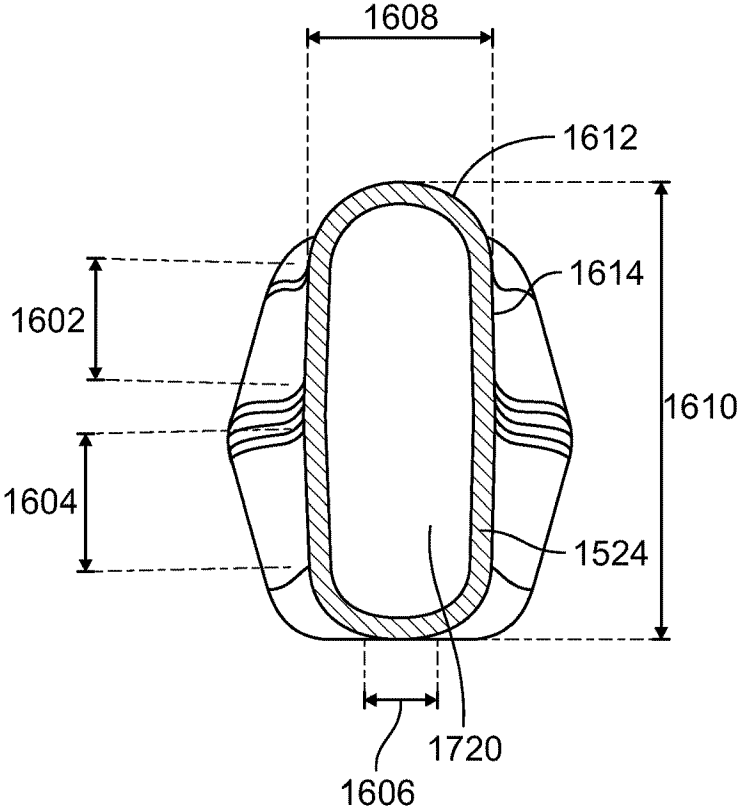
FIGS. 15-23 schematically depict cross-sectional views of the hockey stick shaft of FIG. 14, according to one or more aspects described herein.

FIG. 16 schematically depicts a cross-sectional view corresponding to arrows 16-16 from FIG. 14, according to one or more aspects described herein. The cross-section of FIG. 16 additionally depicts an internal foam core 1522 and carbon-fiber outer walls 1524 that surround the internal foam core 1522. In one specific implementation, the cross-section of FIG. 16 includes the following specific dimensional values, such that length 1602 may equal 0.349 inches. In another example, length 1602 may range between 0.25 and 0.45 inches, among others. Length 1604 may equal 0.404 inches. In another example, length 1604 may range between 0.38 and 0.43 inches, among others. Length 1606 may equal 0.22 inches. In another example, length 1606 may range between 0.19 and 0.25 inches, among others. Length 1608 may be 0.566 inches. In another example, length 1608 may range between 0.45 and 0.7 inches, among others. Length 1610 may be 1.337 inches. In another example, length 1610 may range between 1.1 and 1.6 inches, among others. The radius of curvature 1612 may equal 0.216 inches. In another example, the radius of curvature 1612 may range between 0.19 and 0.23 inches. The radius of curvature 1614 may equal 0.16 inches. In another example, the radius of curvature 1614 may range between 0.12 and 0.2 inches.

Figure 17:
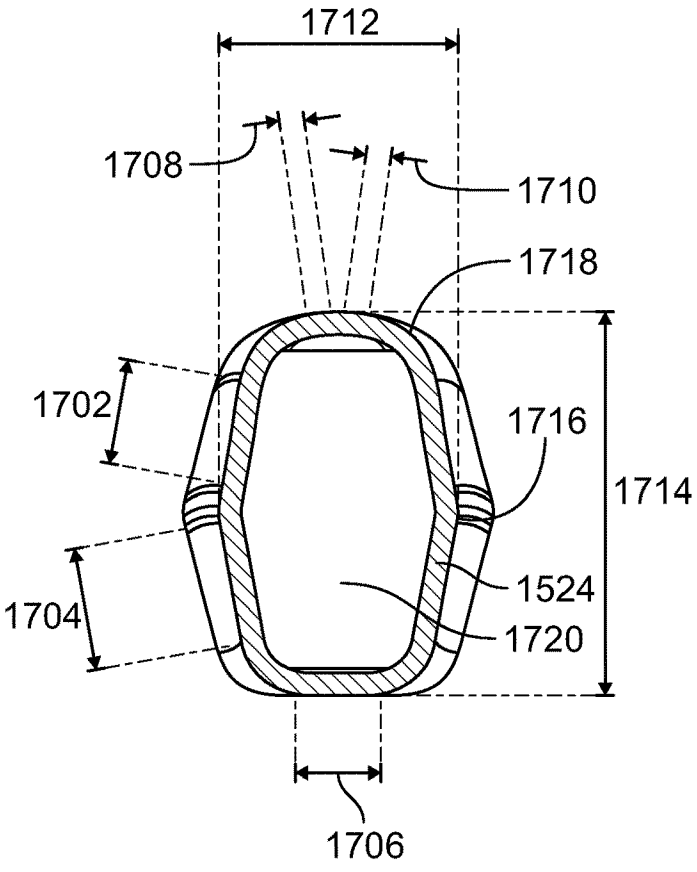

FIG. 17 schematically depicts a cross-sectional view corresponding to arrows 17-17 from FIG. 14, according to one or more aspects described herein. In one example, the cross section of FIG. 17 includes seven sides, similar to FIG. 15. The cross-section of FIG. 17 additionally depicts an internal cavity 1720 formed within the carbon-fiber walls 1524. In one specific implementation, the cross-section of FIG. 17 includes the following specific dimensional values, such that length 1702 may equal 0.341 inches. In another example, length 1702 may range between 0.3 and 0.4 inches, among others. Length 1704 may equal 0.396 inches. In another example, length 1704 may range between 0.37 and 0.43 inches, among others. Length 1706 may equal to 0.27 inches. In another example, length 1706 may range between 0.15 and 0.45 inches, among others. Length 1708 may equal 0.082 inches. In another example, length 1708 may range between 0.06 and 0.1 inches, among others. Length 1710 may equal 0.082 inches. In another example, length 1710 may range between 0.06 and 0.1 inches, among others. The radius of curvature 1716 may equal 0.16 inches. In another example, the radius of curvature 1716 may range between 0.12 and 0.2 inches, among others. The radius of curvature 1718 may equal 0.197 inches. In another example, the radius of curvature 1718 may range between 0.18 and 0.22 inches, among others.

Figure 18:
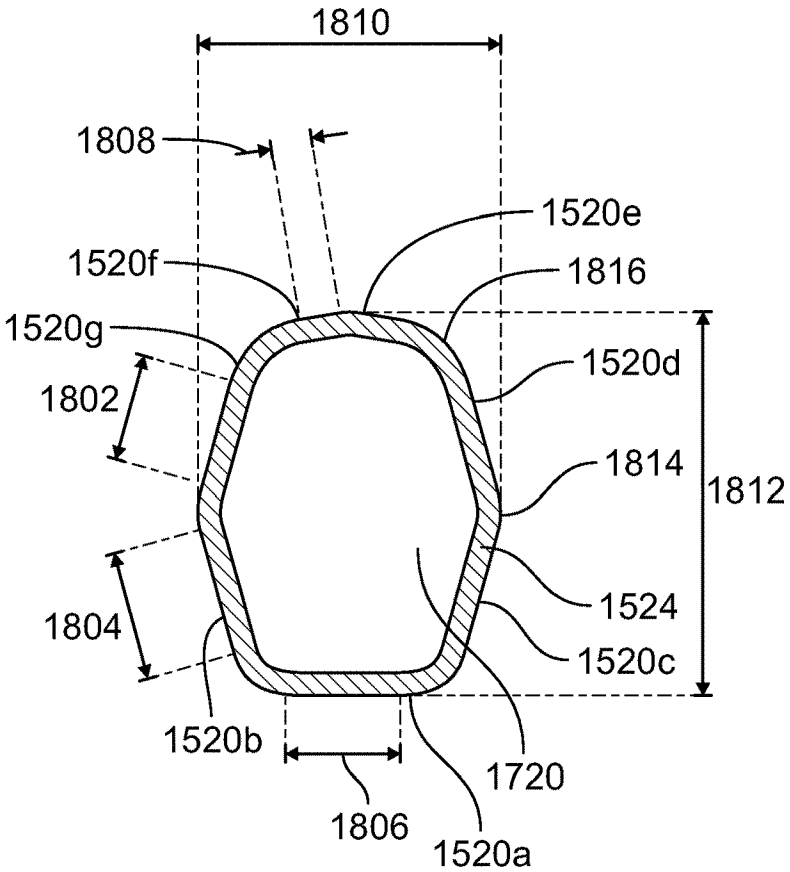

FIG. 18 schematically depicts a cross-sectional view corresponding to arrows 18-18 from FIG. 14, according to one or more aspects described herein. In one example, the cross section of FIG. 18 includes seven sides 1520*a*-1520*g*, similar to FIG. 15. The cross-section of FIG. 18 additionally depicts an internal cavity 1720 formed within the carbon-fiber walls 1524. In one specific implementation, the cross-section of FIG. 18 includes the following specific dimensional values, such that length 1802 may equal 0.351 inches. In another example, length 1802 may range between 0.3 and 0.4 inches, among others. Length 1804 may equal 0.409 inches. In another example, length 1804 may range between 0.38 and 0.43 inches, among others. Length 1806 may equal to 0.38 inches. In another example, length 1806 may range between 0.3 and 0.5 inches, among others. Length 1808 may equal 0.133 inches. In another example, length 1808 may range between 0.1 and 0.16 inches, among others. Length 1810 may equal 0.974 inches. In another example, length 1810 may range between 0.8 and 1.2 inches, among others. Length 1812 may equal 1.231 inches. In another example, length 1812 may range between 1.0 and 1.4 inches, among others. The radius of curvature 1814 may equal 0.16 inches. In another example, the radius of curvature 1814 may range between 0.12 and 0.2 inches, among others. The radius of curvature 1816 may equal 0.216 inches. In another example, the radius of curvature 1816 may range between 0.19 and 0.24 inches, among others.

Figure 19:
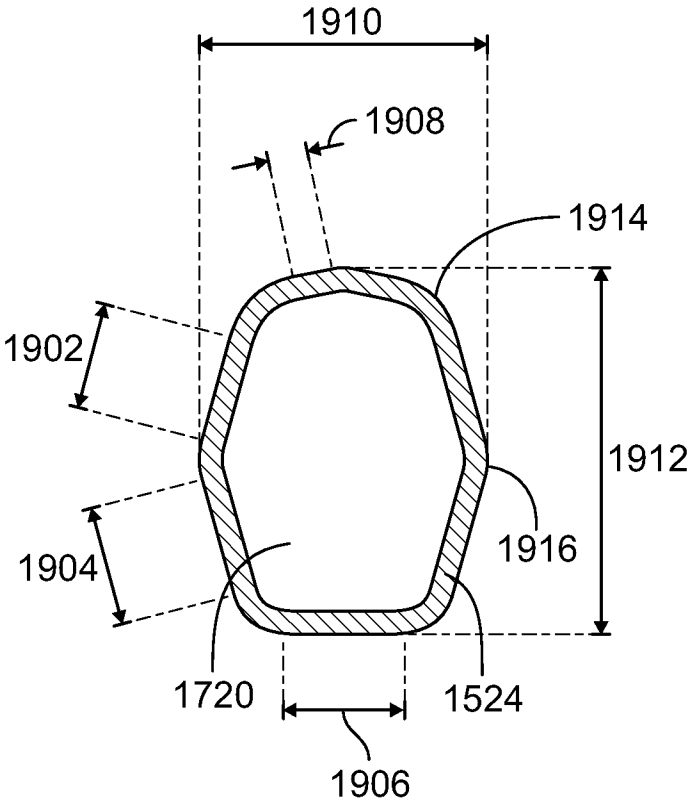

FIG. 19 schematically depicts a cross-sectional view corresponding to arrows 19-19 from FIG. 14, according to one or more aspects described herein. The cross-section of FIG. 19 additionally depicts an internal cavity 1720 formed within the carbon-fiber walls 1524. In one specific implementation, the cross-section of FIG. 19 includes the following specific dimensional values, such that length 1902 may equal 0.357 inches. In another example, length 1902 may range between 0.3 and 0.4 inches, among others. Length 1904 may equal 0.404 inches. In another example, length 1904 may range between 0.38 and 0.43 inches, among others. Length 1906 may equal to 0.41 inches. In another example, length 1906 may range between 0.3 and 0.5 inches, among others. Length 1908 may equal 0.135 inches. In another example, length 1908 may range between 0.12 and 0.17 inches, among others. Length 1910 may equal 0.968 inches. In another example, length 1910 may range between 0.8 and 1.2 inches, among others. Length 1912 may equal 1.233 inches. In another example, length 1912 may range between 1.0 and 1.4 inches, among others. The radius of curvature 1914 may equal 0.197 inches. In another example, the radius of curvature 1914 may range between 0.18 and 0.22 inches, among others. The radius of curvature 1916 may equal 0.16 inches. In another example, the radius of curvature 1916 may range between 0.12 and 0.20 inches, among others.

Figure 20:
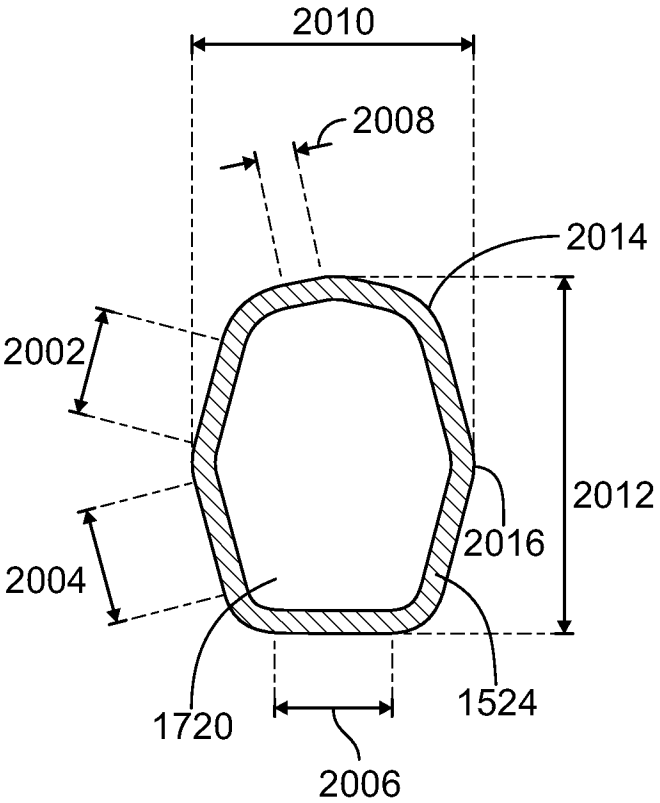

FIG. 20 schematically depicts a cross-sectional view corresponding to arrows 20-20 from FIG. 14, according to one or more aspects described herein. The cross-section of FIG. 20 additionally depicts an internal cavity 1720 formed within the carbon-fiber walls 1524. In one specific implementation, the cross-section of FIG. 20 includes the following specific dimensional values, such that length 2002 may equal 0.357 inches. In another example, length 2002 may range between 0.3 and 0.4 inches, among others. Length 2004 may equal 0.404 inches. In another example, length 2004 may range between 0.38 and 0.43 inches, among others. Length 2006 may equal to 0.41 inches. In another example, length 2006 may range between 0.3 and 0.5 inches, among others. Length 2008 may equal 0.135 inches. In another example, length 2008 may range between 0.12 and 0.17 inches, among others. Length 2010 may equal 0.972 inches. In another example, length 2010 may range between 0.8 and 1.2 inches, among others. Length 2012 may equal 1.233 inches. In another example, length 2012 may range between 1.0 and 1.4 inches, among others. The radius of curvature 2014 may equal 0.197 inches. In another example, the radius of curvature 2014 may range between 0.18 and 0.22 inches, among others. The radius of curvature 2016 may equal 0.16 inches. In another example, the radius of curvature 2016 may range between 0.12 and 0.20 inches, among others.

Figure 21:
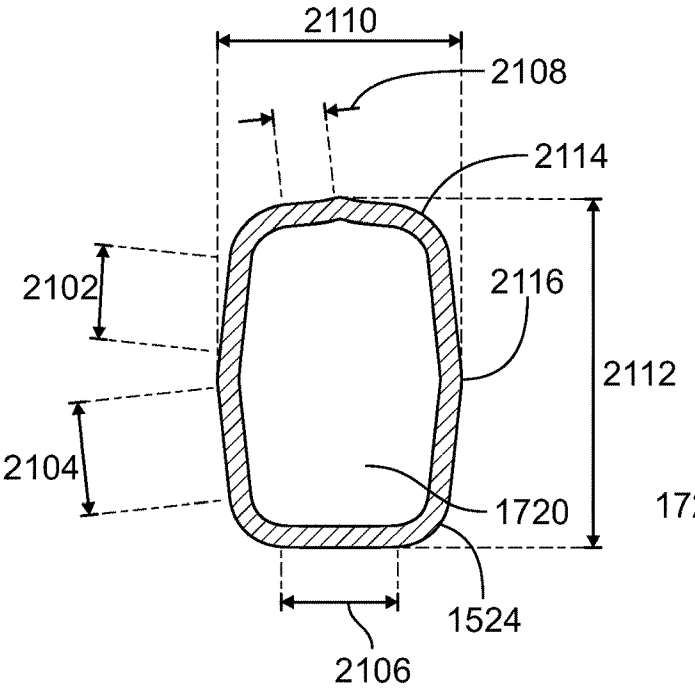

FIG. 21 schematically depicts a cross-sectional view corresponding to arrows 21-21 from FIG. 14, according to one or more aspects described herein. The cross-section of FIG. 21 additionally depicts an internal cavity 1720 formed within the carbon-fiber walls 1524. In one specific implementation, the cross-section of FIG. 21 includes the following specific dimensional values, such that length 2102 may equal 0.329 inches. In another example, length 2102 may range between 0.3 and 0.36 inches, among others. Length 2104 may equal 0.395 inches. In another example, length 2104 may range between 0.38 and 0.43 inches, among others. Length 2106 may equal to 0.41 inches. In another example, length 2106 may range between 0.3 and 0.5 inches, among others. Length 2108 may equal 0.181 inches. In another example, length 2108 may range between 0.16 and 0.20 inches, among others. Length 2110 may equal 0.840 inches. In another example, length 2110 may range between 0.7 and 1.0 inches, among others. Length 2112 may equal 1.203 inches. In another example, length 2112 may range between 1.0 and 1.4 inches, among others. The radius of curvature 2114 may equal 0.173 inches. In another example, the radius of curvature 2114 may range between 0.16 and 0.19 inches, among others. The radius of curvature 2116 may equal 0.16 inches. In another example, the radius of curvature 2116 may range between 0.12 and 0.20 inches, among others.

Figure 22:
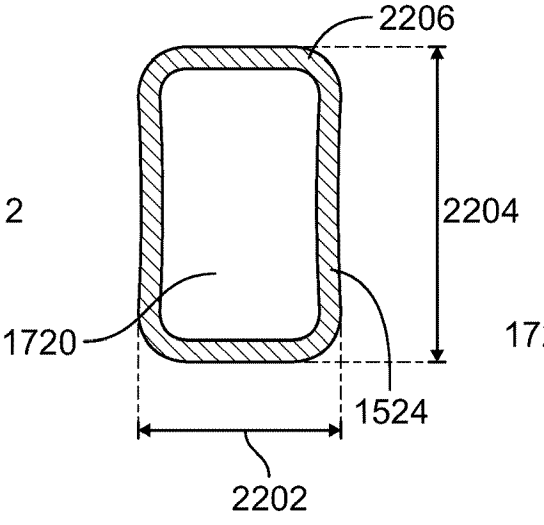

FIG. 22 schematically depicts a cross-sectional view corresponding to arrows 22-22 from FIG. 14, according to one or more aspects described herein. The cross-section of FIG. 22 additionally depicts an internal cavity 1720 formed within the carbon-fiber walls 1524. In one specific implementation, the cross-section of FIG. 22 includes the following specific dimensional values, such that length 2202 may equal 0.753 inches. In another example, length 2202 may range between 0.6 and 0.9 inches, among others. Length 2204 may equal 1.163 inches. In another example, length 2204 may range between 1.0 and 1.3 inches, among others. The radius of curvature 2206 may equal 0.173 inches. In another example, the radius of curvature 2206 may range between 0.16 and 0.19 inches, among others.

Figure 23:
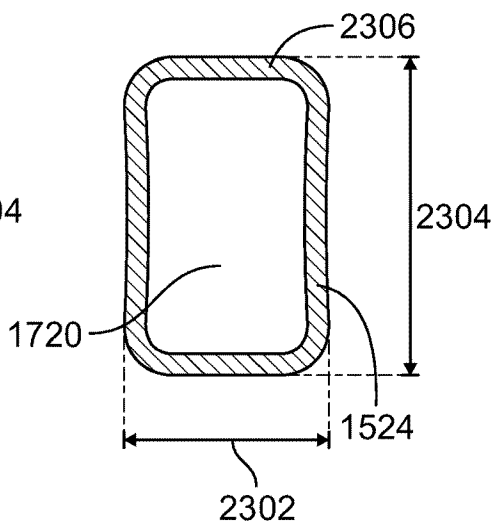

FIG. 23 schematically depicts a cross-sectional view corresponding to arrows 23-23 from FIG. 14, according to one or more aspects described herein. The cross-section of FIG. 23 additionally depicts an internal cavity 1720 formed within the carbon-fiber walls 1524. In one specific implementation, the cross-section of FIG. 23 includes the following specific dimensional values, such that length 2302 may equal 0.750 inches. In another example, length 2302 may range between 0.6 and 0.9 inches, among others. Length 2304 may equal 1.160 inches. In another example, length 2304 may range between 1.0 and 1.3 inches, among others. The radius of curvature 2306 may equal 0.173 inches. In another example, the radius of curvature 2306 may range between 0.16 and 0.19 inches, among others.

In addition to, or as an alternative to the variable pentagonal and heptagonal cross-sectional geometries described in relation to hockey shaft structures 502 and 1402, the thicknesses of the sidewalls 622 and 1524 may vary along the lengths 504 and 1404 of the shafts 502 and 1402. In one example, it is contemplated that the sidewall thickness of sidewalls 622 and/or 1524 may vary by up to 20% along the lengths 504 and 1404 of the respective shafts 502 and 1402. In another example, the sidewall thickness of sidewalls 622 and/or 1524 may be approximately constant along the lengths 504 and 1404 of the respective shafts 502 and 1402.

Figure 24:
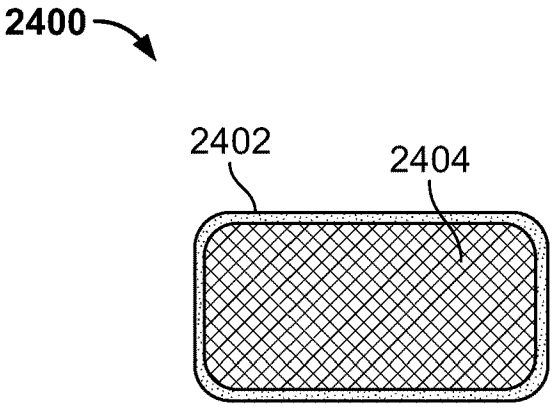

FIGS. 24-28 schematically depict stages of a process for molding a shaft having variable cross-sectional geometry, similar to shafts 102, 502, and 1402. FIG. 24 schematically depicts a wrapped shaft structure 2400 that includes one or more layers of carbon fiber tape (or a polymeric tape that uses an additional or alternative fiber material) 2402. The carbon fiber tape 2402 is wrapped around a mandrel 2404. The mandrel 2404 may have a cross-section that is a rough approximation of the desired cross-section of the hockey stick shaft once molded. As such, the mandrel 2404 may have an approximate rectangular, pentagonal, and/or heptagonal cross-section, among others. In one implementation, the mandrel 2404 is constructed from a metal and/or alloy, such as steel, iron, aluminum, or titanium, among others. It is contemplated that any metal or alloy may be used, in addition to or as an alternative to any ceramic, polymer, or composite material, such as a fiber-reinforced material. The mandrel 2404 may additionally include compressible elements or portions that may allow the wrapped carbon fiber tape 2402 to be removed from the mandrel 2404 prior to molding. Additionally or alternatively, a removal agent, such as a lubricant, may be included in an outer layer of the mandrel 2404 (such as a layer of solid lubricant) or may be added to the mandrel 2404 each use before wrapping with the carbon fiber tape 2402 (such as a liquid lubricant). It is contemplated that the carbon fiber tape 2402 may be wrapped around the mandrel 2404 by one or more machines, or may be manually wrapped. It is contemplated that the carbon fiber tape 2402 may include any number of layers, and that the layers may be oriented in any manner relative to one another, without departing from the scope of these disclosures. In one example, the carbon fiber tape 2402, when removed from the mandrel 2404, may be referred to as a wrapped shaft structure.

Figure 25:
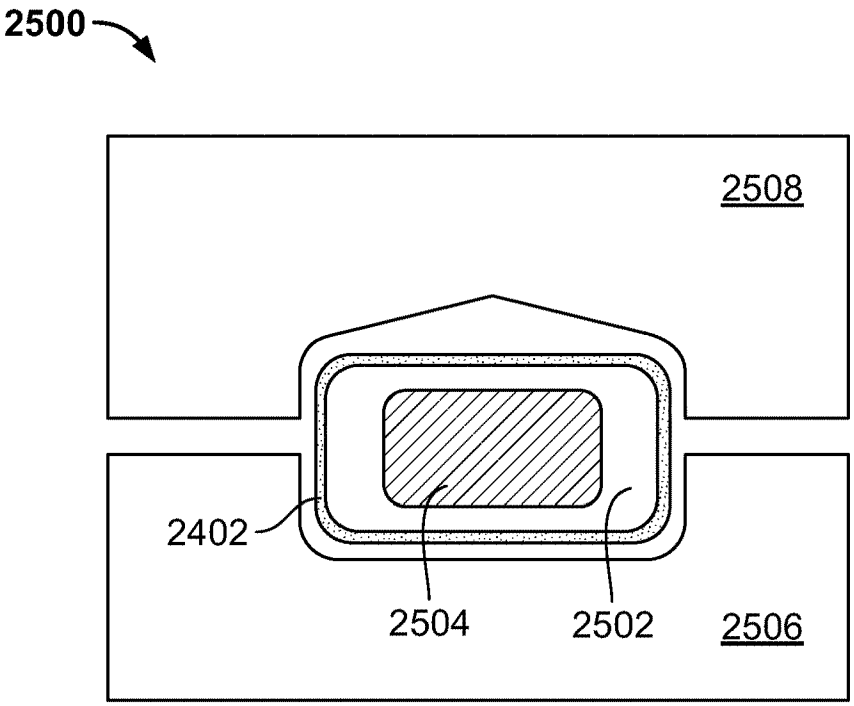
FIGS. 24-28 schematically depict stages of one or more hockey stick shaft molding processes, according to one or more aspects described herein.

FIG. 25 schematically depicts another stage of a molding process of a hockey stick shaft that has variable cross-sectional geometry, similar to shafts 102, 502, and 1402. As depicted in FIG. 25, the carbon fiber tape 2402 has been removed from the mandrel 2404 to reveal an internal shaft cavity 2502. An inflatable bladder 2504 is schematically depicted within the cavity 2502, and the wrapped carbon fiber tape 2402 is schematically depicted within two mold halves 2506 and 2508 of mold 2500. The mold halves 2506 and 2508 are schematically depicted as being partially separated from one another. In the depicted implementation, the mold halves 2506 and 2508 are both female molds. It is contemplated, however, that more than the two depicted mold halves 2506 and 2508 may be used to mold the hockey stick shaft having variable cross-sectional geometry. Alternatively, a male-female mold may be used in place of the female-female mold depicted in FIG. 25.

Figure 26:
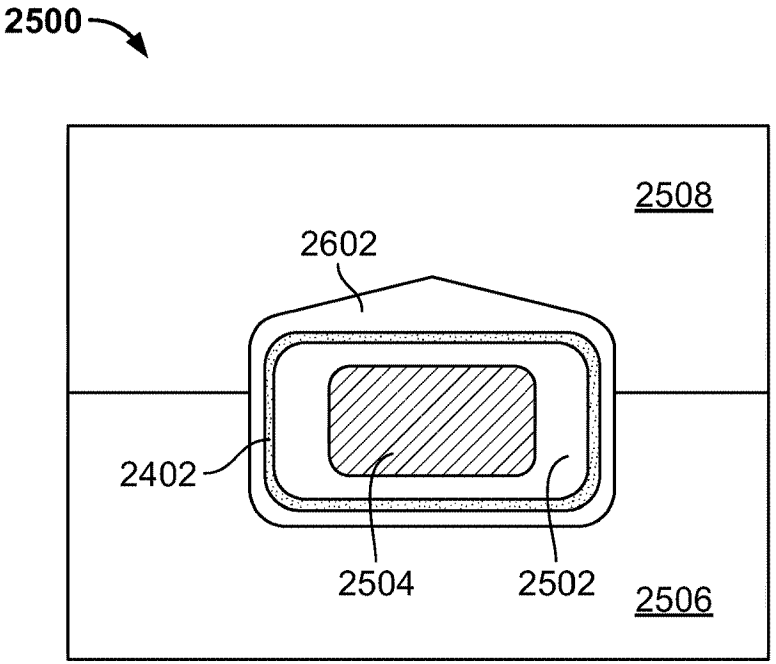

FIG. 25 schematically depicts the mold halves 2506 and 2508 as partially separated from one another. FIG. 26 schematically depicts the mold 2500 once the halves 2506 and 2508 have been closed together. As such, FIG. 26 schematically depicts the five-sided mold geometry 2602 that is to be imparted on the wrapped carbon fiber tape 2402. It is contemplated that the mold geometry 2602 is merely one schematic implementation, and the mold 2500 may have any internal geometry in order to form the variable geometries of hockey stick shafts 102, 502, and 1402.

Figure 27:
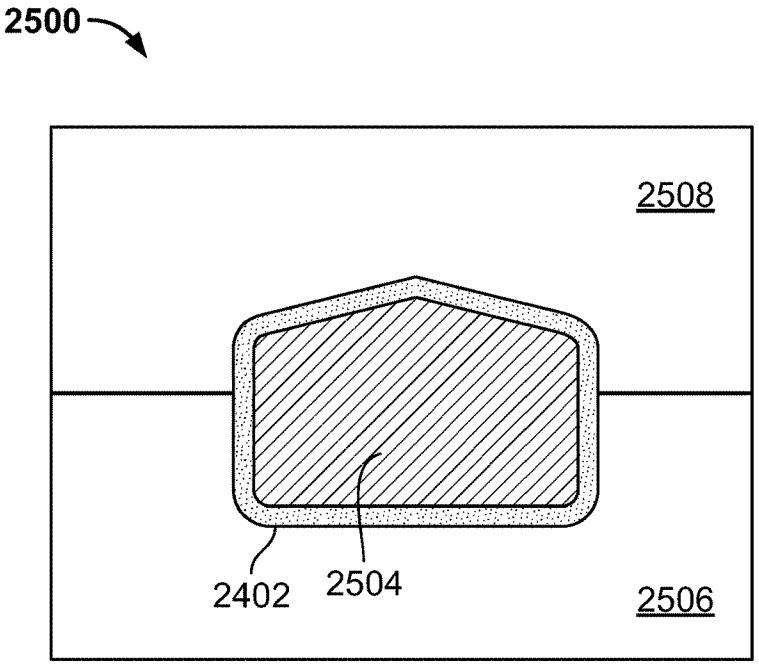

FIG. 27 schematically depicts a further step in the molding process of a hockey stick shaft having variable cross-sectional geometry, similar to hockey stick shafts 102, 502, and 1402. In one example, FIG. 27 schematically depicts one or more processes associated with heating the mold halves 2506 and 2508. The mold 2500 may be heated in order to activate/melt one or more resins preimpregnated within, or applied to, the wrapped fiber tape 2402. Simultaneously or subsequently, the inflatable bladder 2504 is inflated, as depicted in FIG. 27, which imparts a force on the internal walls of the hockey stick shaft and urges the wrapped carbon fiber tape 2402 toward the walls of the mold 2500. As depicted in FIG. 27, the inflatable bladder 2504 may completely fill the internal cavity 2502. It is contemplated that the inflatable bladder 2504 may be used in combination with one or more insert elements configured to apply force to the internal walls of the wrapped carbon fiber tape 2402.

Figure 28:
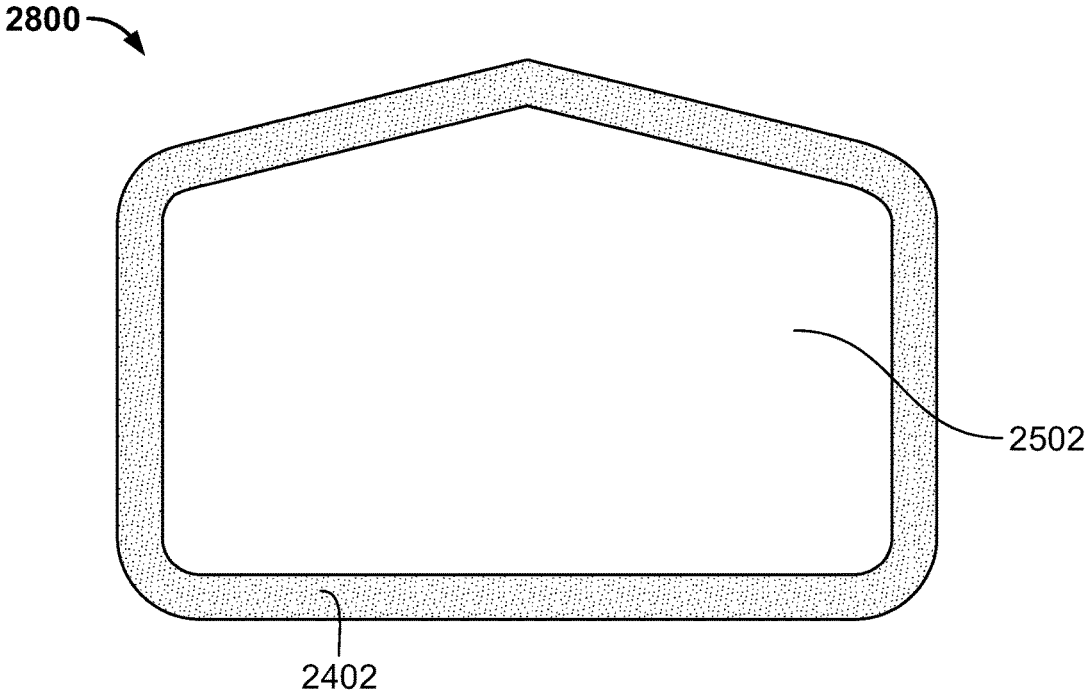

Following the heating and expansion of the bladder 2504 that mold 2500 may be cooled in order to allow the resin on and/or within the wrapped carbon fiber tape 2402 to solidify. The bladder 2504 is deflated and may be removed from the cavity 2502 in order reveal the molded hockey stick shaft. FIG. 28 schematically depicts one example of molded hockey stick shaft 2800, similar to one or more of shafts 102, 502, and 1402. As depicted the bladder 2504 has been removed in order to reveal the internal cavity 2502 that extends along at least a portion of a longitudinal length of the shaft 2800.

As previously described, the use of non-standard geometry in the cross-section of a hockey shaft (i.e. geometry that is not rectangular or rounded rectangular) the hockey shaft may have its flexural rigidity increased by increasing the value of the second moment of inertia, I (see, e.g., Equation 1). By using cross-sectional geometries that vary along the length of the hockey stick shaft (e.g., along the longitudinal length 504 of shaft 502, and/or the longitudinal length 1404 of shaft 1402, otherwise referred to as the shaft lengths 504 and 1404), the flexural rigidity or bending stiffness of a given shaft can vary at different points along the shaft. FIGS. 5-13 and FIGS. 14-23 depict examples of five-sided and seven-sided cross-sectional shaft geometries. It is contemplated, however, that the specific geometries may be varied beyond those described in FIGS. 5-13 and FIGS. 14-23, without departing from the scope of these disclosures.

Further advantageously, the use of cross-sectional geometries that vary along the length of a stick shaft (e.g., along the longitudinal length 504 of shaft 502, and/or the longitudinal length 1404 of shaft 1402) may allow the position of a kick point of a shaft to be specified for a given shaft. As such, it is contemplated that the structures and processes described herein for the production of a hockey stick shafts having variable cross-sectional geometries may be used to position the kick point at any location along a hockey stick, such as hockey stick 100 and/or 400.

Figure 29:
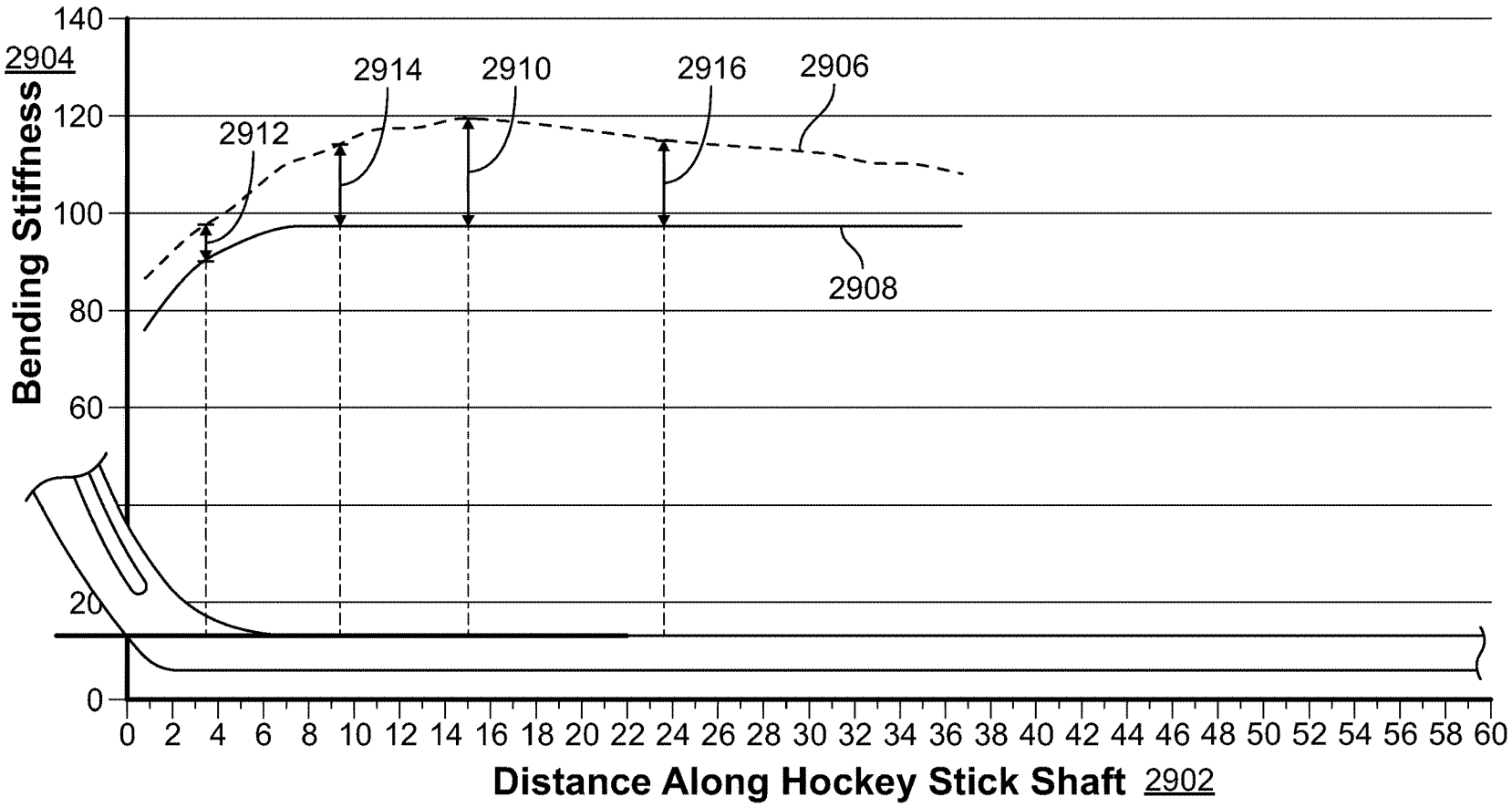
FIG. 29 graphs the bending stiffness of a five-sided hockey stick shaft compared to a conventional hockey stick shaft having a uniform rectangular cross-sectional geometry, according to one or more aspects described herein.

FIG. 29 depicts the bending stiffness of the five-sided hockey stick shaft 502 compared to a conventional hockey stick shaft having a uniform rectangular cross-sectional geometry. In particular, graph 2908 depicts how the bending stiffness (y-axis, 2904) varies along the hockey stick shaft length (x-axis, 2902) for a conventional hockey stick shaft having a uniform rectangular cross-sectional geometry. Graph 2906 depicts how the bending stiffness (y-axis, 2904) varies along the hockey stick shaft length (x-axis, 2902) for the hockey stick shaft 502 of FIG. 5 having pentagonal cross-sectional geometries. In one example, FIG. 29 schematically depicts that the bending stiffness of the pentagonal cross-sectional geometry of shaft 502 represented in graph 2906 may be increased over that of the conventional hockey stick shaft cross-sectional geometry represented in graph 2908 by the difference indicated as 2910. In one example, the variable bending stiffness depicted in graph 2906 may result from a variable shaft geometry, and hence, second moment of inertia, along the shaft length. As such, a first portion of a hockey stick shaft may have a first cross-sectional geometry associated with a first bending stiffness and a second portion of the hockey stick shaft may have a second cross-sectional geometry associated with a second bending stiffness. In one example, a maximum increase in bending stiffness 2910 may be at least 20% or at least 25%. In another example, the increase in bending stiffness 2910 may range between 0% and 40% along the length of the hockey stick shaft.

In another example, a first portion of a hockey stick shaft, such as shaft 502, may have a first bending stiffness, which may be increased over a conventional stick shaft by amount 2912. In one implementation, the amount 2912 may range between 0 and 20%. A second portion of the hockey stick shaft, such as shaft 502, may have a second bending stiffness, which may be increased over a conventional stick shaft by amount 2914. In one implementation, the amount 2914 may range between 0 and 30%. A third portion of the hockey stick shaft, such as shaft 502, may have a third bending stiffness, which may be increased over a conventional stick shaft by amount 2910. In one implementation, the amount 2916 may range between 0 and 40%. A fourth portion of the hockey stick shaft, such as shaft 502, may have a fourth bending stiffness, which may be increased over a conventional stick shaft by amount 2916. In one implementation, the amount 2916 may range between 0 and 35%.

Figure 30:
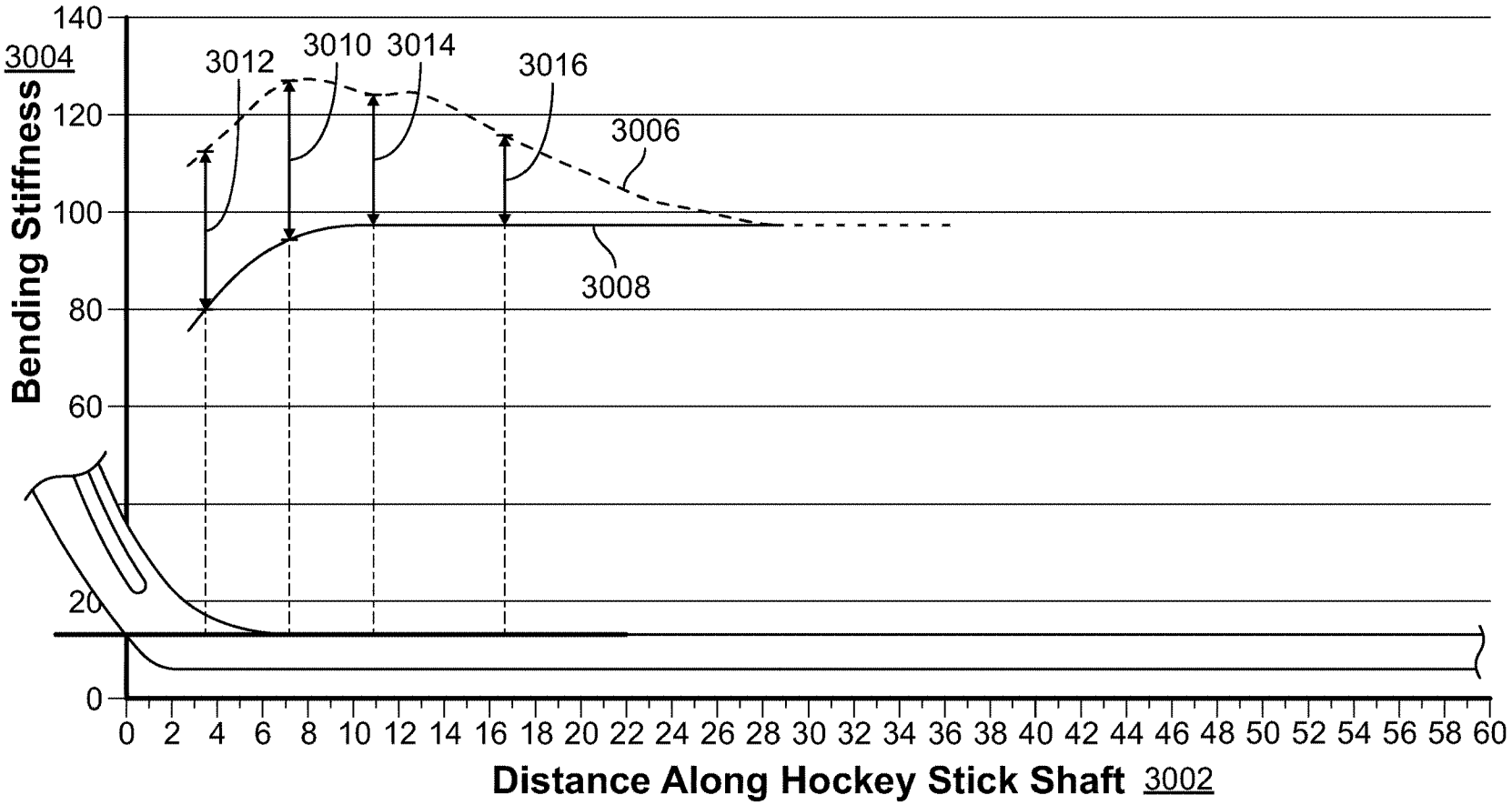
FIG. 30 graphs the bending stiffness of a seven-sided hockey stick shaft compared to a conventional hockey stick shaft having a uniform rectangular cross-sectional geometry, according to one or more aspects described herein.

FIG. 30 depicts the bending stiffness of the seven-sided hockey stick shaft 1402 compared to a conventional hockey stick shaft having a uniform rectangular cross-sectional geometry. In particular, graph 3008 depicts how the bending stiffness (y-axis, 3004) varies along the hockey stick shaft length (x-axis, 3002) for a conventional hockey stick shaft having a uniform rectangular cross-sectional geometry. Graph 2906 depicts how the bending stiffness (y-axis, 3004) varies along the hockey stick shaft length (x-axis, 3002) for the hockey stick shaft 1402 of FIG. 14 having heptagonal cross-sectional geometries. In one example, FIG. 30 schematically depicts that the bending stiffness of the heptagonal cross-sectional geometry of shaft 1402 represented in graph 3006 may be increased over that of the conventional hockey stick shaft cross-sectional geometry represented in graph 3008 by the difference indicated as 3010. In one example, the variable bending stiffness depicted in graph 3006 may result from a variable shaft geometry, and hence, second moment of inertia, along the shaft length. As such, a first portion of a hockey stick shaft may have a first cross-sectional geometry associated with a first bending stiffness and a second portion of the hockey stick shaft may have a second cross-sectional geometry associated with a second bending stiffness. In one example, this maximum increase in bending stiffness 3010 may be at least 25%, or at least 30%. In another example, the increase in bending stiffness 3010 may range between 0% and 40% along the length of the hockey stick shaft.

In another example, a first portion of a hockey stick shaft, such as shaft 1402, may have a first bending stiffness, which may be increased over a conventional stick shaft by amount 3012. In one implementation, the amount 3012 may range between 0 and 35%. A second portion of the hockey stick shaft, such as shaft 1402, may have a second bending stiffness, which may be increased over a conventional stick shaft by amount 3010. In one implementation, the amount 3010 may range between 0 and 50%. A third portion of the hockey stick shaft, such as shaft 1402, may have a third bending stiffness, which may be increased over a conventional stick shaft by amount 3014. In one implementation, the amount 3014 may range between 0 and 40%. A fourth portion of the hockey stick shaft, such as shaft 1402, may have a fourth bending stiffness, which may be increased over a conventional stick shaft by amount 3016. In one implementation, the amount 3016 may range between 0 and 35%.

A formed hockey stick structure may include a shaft that has a variable cross-sectional geometry. In one aspect, a method of fabricating a formed hockey stick structure that has variable shaft geometry may include forming a shaft structure. The formation of the shaft structure may include wrapping a mandrel with fiber tape to form a wrapped shaft structure, removing the mandrel from the wrapped shaft structure to form an internal shaft cavity, and inserting an inflatable bladder into the shaft cavity. The wrapped shaft structure may be positioned within a mold, and the mold may be heated and the bladder may be expanded within the cavity to exert an internal pressure on the cavity to urge the fiber tape toward the walls of the mold. The mold may be cooled and the bladder contracted and removed. The method of fabricating a formed hockey stick structure may additionally include forming a hockey stick blade structure, and coupling the shaft structure to the blade structure. The walls of the mold may impart an outer geometry on the shaft structure that includes a first portion having a cross-sectional geometry with at least five sides along a length of the shaft structure, and the second portion. The first portion of the shaft structure may have a first bending stiffness that is greater than a second bending stiffness of the second portion, due to the first portion having a greater second moment of inertia than the second portion.

In one example, the first portion of the shaft structure may have a first shaft sidewall thickness and the shaft structure may also include a third portion with a second shaft sidewall thickness, less than the first shaft sidewall thickness.

In one example, the cross-sectional geometry of the first portion of a hockey stick shaft structure with at least five sides includes a flat surface facing a front of the hockey stick, and an apex facing a back of the hockey stick.

In another example, the second portion of the shaft structure may have a rectangular cross-section along the length of the shaft structure.

In one example, the first portion and the second portion of the shaft structure may have approximately a same elastic modulus.

In another example, the first portion and the second portion of the shaft structure may have approximately a same sidewall thickness.

In another example, the first portion may have a heptagonal cross-sectional geometry.

In another example, the hockey stick blade structure may include a slot extending from a front face to a back face along a portion of the length of the hockey stick blade structure.

In one example, the slot may be substantially parallel to a top edge of the hockey stick blade structure.

In another aspect, a shaft structure of a hockey stick may be formed by a method that includes the steps of wrapping a mandrel with fiber tape to form a wrapped shaft structure, and removing the mandrel from the wrapped shaft structure to reveal an internal shaft cavity. An inflatable bladder may be inserted into the internal shaft cavity, and the wrapped shaft structure may be positioned within a mold. The mold may be heated and the bladder expanded within the cavity to urge the fiber tape toward the walls of the mold. The mold may be cooled, the bladder contracted, and the bladder removed from the shaft structure. The walls of the mold may impart an outer geometry on the shaft structure that includes a first portion having a cross-sectional geometry with at least five sides along a length of the shaft structure, and a second portion. The first portion of the shaft structure may have a first bending stiffness that is greater than a second bending stiffness of the second portion, due to the first portion having a greater second moment of inertia than the second portion.

In one example, the first portion of the shaft structure may have a first shaft sidewall thickness and the shaft structure further includes a third portion with a second shaft sidewall thickness, less than the first shaft sidewall thickness.

In one example, the cross-sectional geometry of the first portion of the shaft structure with at least five sides includes a flat surface facing a front of the hockey stick, and an apex facing a back of the hockey stick.

In another example, the second portion of the shaft structure has a rectangular cross-section.

In another example, the first portion and the second portion of the shaft structure may have approximately a same elastic modulus.

In another example, the first portion and the second portion of the shaft structure have approximately a same sidewall thickness.

In one example, the first portion may have a heptagonal cross-sectional geometry.

In another aspect, a hockey stick apparatus may include a hollow shaft structure molded from wrapped fiber tape, with the hollow shaft structure further including a longitudinal length of first portion of which may have a cross-sectional geometry with at least five sides and a first flexural rigidity. A second portion of the longitudinal length of the hollow shaft structure may have a second flexural rigidity less than the first flexural rigidity. A molded blade structure may be rigidly coupled to a proximal end of the hollow shaft structure.

In one example, the first flexural rigidity of the first portion may be higher than the second flexural rigidity due to a higher second moment of area of the cross-sectional geometry of the first portion, and the elastic moduli of the materials of the first portion and the second portion may be approximately the same.

In another example, the first portion and the second portion of the hollow shaft structure may have an approximately same sidewall thickness.

In yet another example, the first portion may have a heptagonal cross-sectional geometry.

In another example, the molded blade structure may include a slot extending from a front face to a back face along a portion of a length of the molded blade structure.

In another example, the slot may be substantially parallel to a top edge of the molded blade structure.

The present disclosure is disclosed above and in the accompanying drawings with reference to a variety of examples. The purpose served by the disclosure, however, is to provide examples of the various features and concepts related to the disclosure, not to limit the scope of the invention. One skilled in the relevant art will recognize that numerous variations and modifications may be made to the examples described above without departing from the scope of the present disclosure.

We claim:

1. A shaft structure of a hockey stick formed by a method comprising the steps of:

wrapping a mandrel with fiber tape to form a wrapped shaft structure;

removing the mandrel from the wrapped shaft structure to reveal an internal shaft cavity;

inserting an inflatable bladder into the internal shaft cavity;

positioning the wrapped shaft structure within a mold;

heating the mold and expanding a bladder within the cavity to urge the fiber tape toward the walls of the mold; and cooling the mold, contracting the bladder, and removing the bladder from the shaft structure, wherein the walls of the mold impart an outer geometry on the shaft structure that includes a first portion having a cross-sectional geometry with at least five sides along a length of the shaft structure, and a second portion, wherein the first portion has a bending stiffness that varies along the length of the first portion and is greater than a second bending stiffness of the second portion, due to the first portion having a greater second moment of inertia than the second portion, wherein the first portion has a maximum bending stiffness at a point along the shaft between 11 and 18 inches from heel of the hockey stick, and wherein the maximum bending stiffness is at least 10% higher than a bending stiffness at a point where the shaft structure is coupled to a blade of the hockey stick.

2. The shaft structure according to claim 1, wherein the first portion of the shaft structure has a first shaft sidewall thickness and the shaft structure further includes a third portion with a second shaft sidewall thickness, less than the first shaft sidewall thickness.

3. The shaft structure according to claim 1, wherein the cross-sectional geometry of the first portion of the shaft structure with at least five sides includes a flat surface facing a front of the hockey stick and an apex facing a back of the hockey stick.

4. The shaft structure according to claim 1, wherein the second portion of the shaft structure has a rectangular cross-section.

5. The shaft structure according to claim 1, wherein the first portion and the second portion of the shaft structure have approximately a same elastic modulus.

6. The shaft structure according to claim 5, wherein the first portion and the second portion of the shaft structure have approximately a same sidewall thickness.

7. The shaft structure according to claim 1, wherein the first portion has a heptagonal cross-sectional geometry.

8. A hockey stick apparatus, comprising:

a hollow shaft structure molded from wrapped fiber tape, further comprising:

a longitudinal length, a first portion of which has a cross-sectional geometry with at least five sides and a first flexural rigidity, and a second portion of which has a second flexural rigidity, less than the first flexural rigidity; and a molded blade structure, rigidly coupled to a proximal end of the hollow shaft structure, wherein the first portion has a maximum bending stiffness at a point along the shaft between 3 and 9 inches from heel of the hockey stick, and wherein the maximum bending stiffness is at least 10% higher than a bending stiffness at a point where the shaft structure is coupled to a blade of the hockey stick.

9. The hockey stick apparatus of claim 8, wherein the first flexural rigidity of the first portion is higher than the second flexural rigidity due to a higher second moment of area of the cross-sectional geometry of the first portion, and wherein the first portion and the second portion of the shaft structure have approximately a same elastic modulus.

10. The hockey stick apparatus of claim 9, wherein the first portion and the second portion of the hollow shaft structure have an approximately same sidewall thickness.

11. The hockey stick apparatus of claim 9, wherein the first portion has a heptagonal cross-sectional geometry.

12. The hockey stick apparatus of claim 9, wherein the molded blade structure comprises a slot extending from a front face to a back face along a portion of a length of the molded blade structure.

13. The hockey stick apparatus of claim 12, wherein the slot is substantially parallel to a top edge of the molded blade structure.

* * * * *